US005610628A

United States Patent [19]

Yamamoto et al.

[11] Patent Number: 5,610,628

[45] Date of Patent: Mar. 11, 1997

[54] DRIVING DEVICE FOR A DISPLAY PANEL AND A DRIVING METHOD OF THE SAME

[75] Inventors: Kunihiko Yamamoto, Kashiba; Kiyohisa Matsui, Yamatokoriyama; Yutaka Ishii, Nara; Norio Yasunishi, Yamatokoriyama; Toshihiro Nakamura, Tenri; Hajime Washio, Hamamatsu; Koki Taniguchi, Osaka, all of Japan

[73] Assignee: Sharp Kabushiki Kaisha, Osaka, Japan

[21] Appl. No.: 447,246

[22] Filed: May 22, 1995

Related U.S. Application Data

[62] Division of Ser. No. 132,651, Oct. 5, 1993.

[30] Foreign Application Priority Data

Oct. 7, 1992 [JP] Japan ..... 4-268982
Oct. 30, 1992 [JP] Japan ..... 4-293529

[51] Int. Cl.[6] ..... G09G 3/36

[52] U.S. Cl. ..... 345/100; 345/94; 345/208

[58] Field of Search ..... 345/87, 94, 100, 345/211, 95, 208

[56] References Cited

U.S. PATENT DOCUMENTS

| | | | |
|---|---|---|---|
| 5,475,397 | 12/1995 | Saidi | 345/100 |
| 5,481,651 | 1/1996 | Herold | 345/100 |
| 5,485,173 | 1/1996 | Schiffer et al. | 345/100 |
| 5,489,919 | 2/1996 | Kuwata et al. | 345/100 |

FOREIGN PATENT DOCUMENTS

| | | |
|---|---|---|
| 0507061A2 | 10/1992 | European Pat. Off. . |
| 2002562 | 2/1979 | United Kingdom . |

OTHER PUBLICATIONS

Ruckmongathan et al, "New Addressing Technique for Multiplexed Crystal Displays", Proceedings of The SID, vol. 24, No. 3, 1983, Los Angeles US, pp. 259–262.

T. J. Scheffer et al, SID 92 Digest, pp. 228–231, "Active Addressing Method for High–Contrast Video–Rate STN Displays".

T. N. Ruckmongathan, 1988 IEEE, p. 80, "1988 International Display Research Conference".

Ruckmongathan, "A Generalized Addressing Technique for RMS Responding Matrix LDC's", International Display Research Conference 1988 Oct., New York, pp. 80–85.

Clifton et al, "Hardware Architecture for Video Rate, Active Addressed STN Displays", Proceedings Japan Display 92 1992, Hiroshima, Japan, pp. 503–506.

*Primary Examiner*—Richard Hjerpe
*Assistant Examiner*—Amare Mengistu
*Attorney, Agent, or Firm*—Nixon & Vanderhye P.C.

[57] ABSTRACT

A driving device for a display apparatus having excellent contrast and a high display quality without crosstalk and display irregularities, and a driving method for the same are provided. In the driving device, scanning signals and data signals having a plurality of periodical inactive portions in one frame are applied to respective display dots. In the inactive term, a fixed voltage is applied to each of the display dots. The signal applied to the display dot is divided into small terms by the inactive portions, resulting in more high frequency components in a voltage signal applied to the display dot. As a result, the frequency components of a driving signal applied to the display dot are averaged. Further, a complete orthogonal function having $2^r$ base function series is used, and a desired display data is completely reproduced on the display apparatus by an arithmetic process assuming auxiliary data in accordance with the number of the scanning electrodes.

11 Claims, 17 Drawing Sheets

FIG. 9
(PRIOR ART)
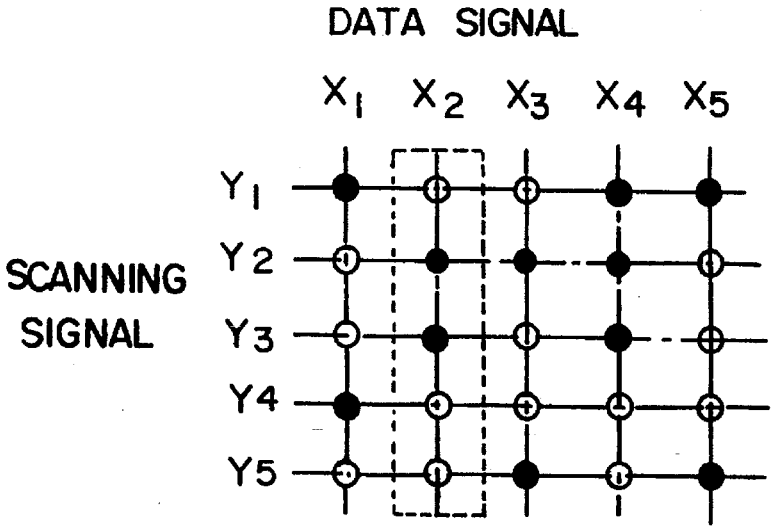
FIG. 10A
(PRIOR ART)
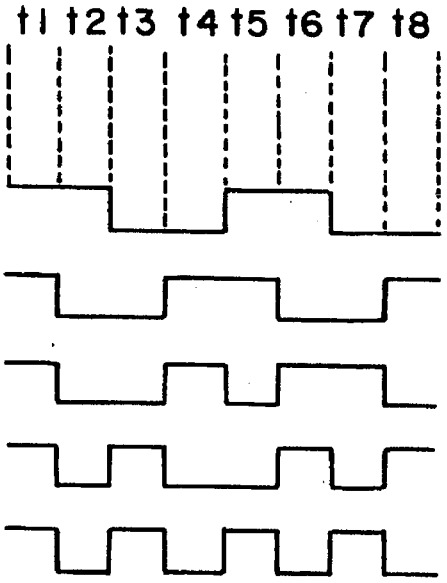
FIG. 10B
(PRIOR ART)
| | 1 FRAME | | | | | | | |
|---|---|---|---|---|---|---|---|---|
| | t1 | t2 | t3 | t4 | t5 | t6 | t7 | t8 |
| Y1 | +1 | +1 | -1 | -1 | +1 | +1 | -1 | -1 |
| Y2 | +1 | -1 | -1 | +1 | +1 | -1 | -1 | +1 |
| Y3 | +1 | -1 | -1 | +1 | -1 | +1 | +1 | -1 |
| Y4 | +1 | -1 | +1 | -1 | -1 | +1 | -1 | +1 |
| Y5 | +1 | -1 | +1 | -1 | +1 | -1 | +1 | -1 |

FIG. 11
(PRIOR ART)
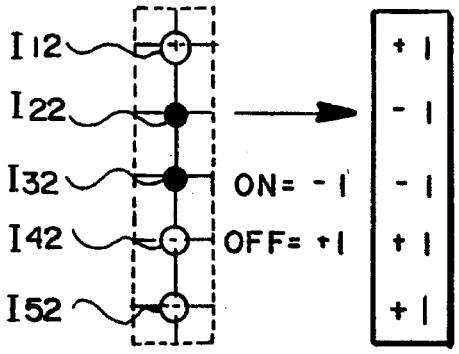
FIG. 12A
(PRIOR ART)
| | t1 | t2 | t3 | t4 | t5 | t6 | t7 | t8 |
|---|---|---|---|---|---|---|---|---|
| Y1 I12 | +1 | +1 | -1 | -1 | +1 | +1 | -1 | -1 |
| Y2 I22 | -1 | +1 | +1 | -1 | -1 | +1 | +1 | -1 |
| Y3 I32 | -1 | +1 | +1 | -1 | +1 | -1 | -1 | +1 |
| Y4 I42 | +1 | -1 | +1 | -1 | -1 | +1 | -1 | +1 |
| Y5 I52 | +1 | -1 | +1 | -1 | +1 | -1 | +1 | -1 |
| g2 | +1 | +1 | +3 | +5 | +1 | +1 | -1 | -1 |
FIG. 12B
(PRIOR ART)
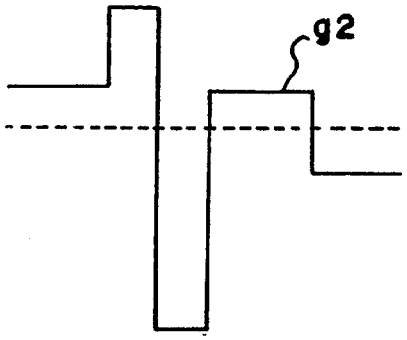

FIG. 13A
(PRIOR ART)
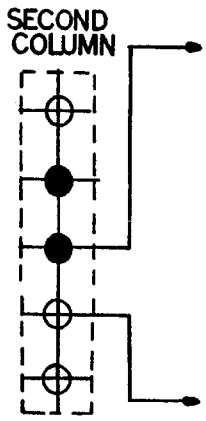
FIG. 13B
(PRIOR ART)
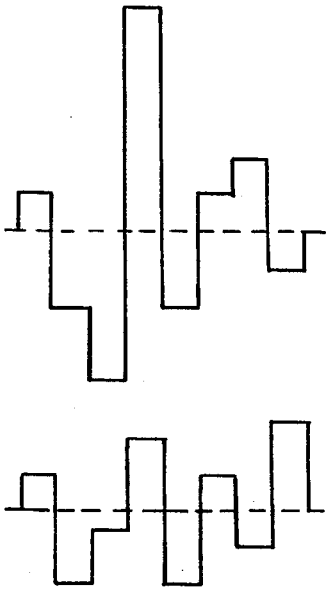
FIG. 13C
(PRIOR ART)
| | t1 | t2 | t3 | t4 | t5 | t6 | t7 | t8 | EFFECTIVE VOLTAGE VALUE(rms) |
|---|---|---|---|---|---|---|---|---|---|
| $g_2$ | 1 | 1 | 3 | -5 | 1 | 1 | -1 | -1 | |
| $Y_3$ | 1 | -1 | -1 | 1 | -1 | 1 | 1 | -1 | |
| $Y_4$ | 1 | -1 | 1 | -1 | -1 | 1 | -1 | 1 | |
| $Y_3-C_{g2}$ | 0.575 | -1.425 | -2.275 | 3.125 | -1.425 | 0.575 | 1.425 | -0.575 | 1.66 |
| $Y_4-C_{g2}$ | 0.575 | -1.425 | -0.275 | 1.125 | -1.425 | 0.575 | -0.575 | 1.425 | 1.03 |
C:0.425

DRIVING DEVICE FOR A DISPLAY PANEL AND A DRIVING METHOD OF THE SAME

This is a divisional of application Ser. No. 08/132,651, filed Oct. 5, 1993.

BACKGROUND OF THE INVENTION

1. Field of the Invention

The present invention relates to a driving device for display panels used in AV (audiovisual) equipment, OA (office automation) equipment, computer terminals with a communication function and the like.

2. Description of the Related Art

The desire for a large-scale display apparatus with a large display capacity has recently increased as society has become more information-oriented. In order to satisfy such a desire, a CRT (cathode-ray tube), which is considered to be the best display device in service today, has been developed to be more refined and have a large-scale. For example, a direct view type CRT has attained a size of approximately 40 inches, and a projection type CRT has attained a size of approximately 200 inches. In realizing a large-scale CRT with a large display capacity, however, problems of weight and depth become more severe. Therefore, there is a strong demand for a method for attaining a large-scale CRT with a large capacity without causing such problems.

A flat type display apparatus, which employs a different theory of display from that of the CRT, has been used in word processors, personal computers or the like. A development has been also made in such a flat type display apparatus so as to attain a sufficiently high display quality to be used for an HDTV or a high performance EWS (engineering work station).

The flat type display apparatus is classified into an ELP (electroluminescent panel), a PDP (plasma display panel), a VFD (vacuum fluorescent display), an ECD (electro chlomic display), an LCD (liquid crystal display) and the like. The LCD is regarded as the most promising and has been developed most significantly among those mentioned because it can easily achieve a multicolor display and can be matched with an LSI (large scale integrated circuit).

The LCD is classified into a simple matrix driving type LCD and an active matrix driving type LCD. The simple matrix driving type LCD has a structure in which liquid crystal is enclosed in an XY matrix type panel comprising a pair of glass substrates respectively bearing electrodes in the shape of stripes formed thereon. The glass substrates are opposed to each other so as to make the electrodes on one of the substrates vertical to the electrodes on the other substrate. This type of LCD utilizes sharpness of liquid crystal display characteristics to display an image. The active matrix driving type LCD has a structure in which nonlinear elements are directly connected to pixels, and positively utilizes nonlinear characteristics such as a switching characteristic of each element for displaying an image. Therefore, the active matrix driving type LCD depends upon the display characteristics of the liquid crystal itself less than the simple matrix driving type LCD, and can realize a display with high contrast and fast response. The nonlinear elements used in the active matrix driving type LCD are divided into two types: a two-terminal type and a three-terminal type. Examples of the two-terminal type nonlinear element include an MIM (metal-insulator-metal), a diode and the like. Examples of the three-terminal type nonlinear element include a TFT (thin film transistor), an Si-MOS (silicon metal oxide semiconductor), SOS (silicon on sapphire) and the like.

In spite of the above-mentioned advantages of the active matrix driving type LCD, the simple matrix driving type LCD is advantageous in the production cost because it has a simpler display panel structure.

In the simple matrix driving type LCD, the ratio of the effective voltage applied to a selected pixel to that applied to a non-selected pixel becomes almost 1:1 as the number of scanning electrodes increases. Therefore, in order to attain high contrast, the liquid crystal used in such an LCD is required to have sharpness of the display characteristics. An STN (super twisted nematic) LCD is generally used for achieving this sharpness. In the STN LCD, the liquid crystal molecules are twisted through an angle of approximately 180° to 270°, and a polarizer is further used. In addition, an STN LCD further including a compensator made from liquid crystal or a polymer film is commercially available.

The response characteristic of an LCD is generally contradictory to the contrast characteristic thereof. This can be partly explained by the driving voltage waveform of the LCD. In the XY matrix driving method usually used in the simple matrix driving type LCD, each of the scanning electrodes is successively selected, and synchronously with the selection, signals corresponding to display data are applied to data electrodes vertical to the scanning electrodes at a time. In this method, the voltage applied to each pixel can be indicated as FIG. 8A. During one frame while all the scanning electrodes are successively selected to be turned on, a high voltage T is applied at least once, otherwise, a constant low bias voltage U is mainly applied.

In a fast responding LCD, which is realized by using a liquid crystal material having optimal characteristic values such as viscosity and layer thickness, the transmission of the LCD varies, as shown in FIG. 8B, in response to the above-mentioned variations between the voltages T and U. Such phenomena will be hereinafter referred to as the "frame response phenomena". Because of the phenomena, the transmission deviates from an optimal effective response line of the applied voltage, which is shown with a dashed line in FIG. 8B. As a result, the contrast of the LCD is degraded.

The following two methods have been recently proposed as a driving method for suppressing the frame response phenomena: One is the so-called active addressing system. In this method, while positive or negative voltages derived from the Walsh function are simultaneously applied to all the scanning electrodes, data signals correlated with display data input from the outside are transferred to the data electrodes synchronously with the application of the voltages (T. J. Scheffer, et al., SID '92, Digest, p. 228). The other is the so-called multiple line selection system. In this method, positive or negative voltages based on the binary system or voltages of 0 are applied to a plurality of scanning electrodes (T. N. Ruckmongathan, 1988 IDRC p. 80).

An example of the specific procedure in the active addressing system will now be described. Scanning signals $Y_n$ (n=1 to 5) for a dot matrix of five columns by five rows as shown in FIG. 9 are determined by using the Walsh function as shown in FIGS. 10A and 10B. Specifically, five different kinds of signal patterns are applied to the respective scanning signals $Y_n$ as shown in FIG. 10A. One frame is divided into eight terms $t_1$ to $t_8$. The on state is taken as +1 and the off state is taken as −1. Under these conditions, the signal patterns of the scanning signals $Y_n$ in one frame are shown with +1 and −1 as in FIG. 10B.

Next, data signals $X_m$ (m=1 to 5) are obtained as follows: FIG. 11 shows the data signal when m=2. Display data $I_{km}$ (k=1 to 5) for the respective dots in the mth column are indicated with one of the two values: −1 (the on state) and +1 (the off state). The value of the display data $I_{km}$ is multiplied by the scanning signal $Y_k$. FIG. 13A shows $Y_k I_{km}$, the results of the multiplication in the case of m=2. Then, the obtained results are added with k in each term, thereby obtaining added values $g_m$ as shown in FIG. 12A. In FIG. 12B, the added values $g_m$ are indicated as a voltage level when m=2.

The data signal $X_m$ is indicated as a product obtained by multiplying the added value $g_m$ by a constant C. The constant C depends upon the number N of the scanning electrodes alone, and is represented by an equation described below. When the number N is 5, the constant C is 0.425.

$$X_2 = C \cdot g_2$$

$$C = [1/(2(N - \sqrt{N}))]^{1/2}$$

When all the scanning signals $Y_n$ (n=1 to 5) and the data signals $X_m$ (m=1 to 5) are simultaneously applied to the respective scanning electrodes and data electrodes for a face scanning, the display data $I_{nm}$ is displayed on the display panel. The arithmetical procedure is as follows: The signal to be applied to each display dot (n,m) is represented by a difference between the signals $Y_n$ and $X_m$. By conducting the face scanning, an image corresponding to the effective voltage value in one frame is displayed by each display dot. Therefore, the voltage applied to the display dot (n,m) is represented by the following equation:

$$V = \sqrt{\frac{1}{T}\int_0^T \{Y_n(t_j) - X_m(t_j)\}^2 dt}$$

wherein $t_j$ is a term into which a frame is divided; and I/T is a normalization constant. In the above description, since one frame is divided into eight terms, $t_j$ corresponds to $t_1$ to $t_8$, and T is 8. $Y_n(t_j)$ and $X_m(t_j)$ are values of $X_n$ and $Y_m$ in each term $t_j$, respectively (see FIG. 10). In addition, since $Y_n(t_j)$ is an orthogonal function, the following equations hold:

$$\sqrt{\frac{1}{T}\int_0^T Y_n(t)Y_k(t)dt} \simeq \begin{cases} \delta_{nk} & (n=k) \\ 0 & (n \neq k) \end{cases}$$

$$X_m(t_j) \simeq Cg_m(t_j) = C\sum_k Y_k(t_j)I_{km}$$

In this manner, each of the signals is applied to the display dot (n,m) during one frame, and the display data is reproduced on the display dot (n,m).

In FIG. 13A, the display dots in the on state are shown with ● and the display dots in the off state are shown with ○. FIG. 13B shows the voltage waveform of an on-state dot in the second column and the third row and that of an off-state dot in the second column and the fourth row in FIG. 13A.

Next, an example of the specific procedure in the multiple line selection system will be described. For example, a group of three scanning electrodes as shown in FIG. 14 is simultaneously selected, and a voltage of +Vr or −Vr is successively applied to each group for scanning. Therefore, voltages of three values, i.e., +Vr, −Vr, and 0 at the time of non-selection, are used as the scanning voltages in this system.

The display pattern of the on state is taken as 1, and that of the off state is taken as 0. The voltage +Vr of the scanning electrode is taken as 1, and the voltage −Vr is taken as 0. These values are respectively applied to bits, and the exclusive OR operation is conducted to determine the voltage of one data electrode. At this point, the data voltage is required to have M+1 voltage levels if a multicolor display is desired, wherein M is the number of the selected lines, i.e., 3 in the above case.

Next, the scanning voltage and the data voltage determined as above are simultaneously applied to the first group of the scanning electrodes. A similar procedure is repeated with regard to each group of the plurality of scanning electrodes. As a result, the panel displays an image corresponding to the display data.

As is known from the above description, a plurality of selections for the scanning electrodes are performed in one frame in these systems. Therefore, each of the applied voltage values of the respective waves in one frame approaches the average thereof, thereby suppressing the frame response phenomena, which is caused in the conventional method in which only one selection is performed in one frame.

FIG. 15 shows, as an example of the specific circuit, an LCD system having a driving device of an active addressing system. The LCD system has an XY matrix type LCD 1. The LCD 1 comprises a liquid crystal layer, and scanning electrodes 1*a* and data electrodes 1*b* oppose each other so as to sandwich the liquid crystal layer therebetween. For example, the data electrodes 1*b* are 15 electrodes to which data signals $X_1$ to $X_{15}$ are respectively input. The scanning electrodes 1*a* are 15 electrodes to which scanning signals $Y_1$ to $Y_{15}$ are respectively input. A portion on which each scanning electrode 1*a* and each data electrode 1*b* cross each other works as a display dot (a pixel).

The data electrodes 1*b* are connected to a data electrode driving circuit 4, and the scanning electrodes 1*a* are connected to a scanning electrode driving circuit 5. The scanning electrode driving circuit 5 has, in each output system, a transfer gate 5*a* to which a voltage of +Vr is applied and a transfer gate 5*b* to which a voltage of −Vr is applied, as shown in FIG. 16. The scanning electrode driving circuit 5 selects one of the voltage levels, +Vr or −Vr, on the basis of a timing signal as shown in FIG. 15 to output the scanning signals $Y_1$ to $Y_{15}$ to the respective scanning electrodes 1*a*.

The data electrode driving circuit 4 has, in each output system, a sampling gate 4*a*, a transfer gate 4*b*, a sampling capacitor 4*c*, a transfer capacitor 4*d* and an output buffer 4*e* as shown in FIG. 17. The data electrode driving circuit 4 successively samples the data signals $X_1$ to $X_{15}$, obtained as the results of the calculation, in accordance with the timing signal. When it finishes sampling all the data signals for one scanning electrode, it outputs the sampled data signals to the respective data electrodes 1*b*.

The data electrode driving circuit 4 receives an output signal from an orthogonal transformation arithmetic circuit 3. The orthogonal transformation arithmetic circuit 3 receives an image data signal, a timing signal and a signal Y that is output by a Walsh function generator 2. The Walsh function generator 2 receives a timing signal. The scanning electrode driving circuit 5 receives a timing signal and a signal Y that is output by the Walsh function generator 2.

In the driving circuit of the active addressing system having the above-mentioned structure, signals are processed as follows: The Walsh function generator 2 provides a signal Y with a voltage waveform indicating the Walsh function. The signal is sent to each of the scanning electrodes 1*a* through the scanning electrode driving circuit 5. The orthogonal transformation arithmetic circuit 3 divides the image data signals input from the outside into two types of signals, +1 and −1, multiplies each of the signals by the signal Y sent from the Walsh function generator 2, and obtains the respective added values g as described above, thereby obtaining signals X by multiplying the added values g by the constant C. The signals X are sent to the respective data electrodes 1*b* through the data electrode driving circuit 4. In this manner, when the voltage application for one frame is finished, an original image is reproduced on the LCD 1.

FIGS. 18A, 18B, 18C and 18D respectively show the voltage waveforms of data signal $X_1$, scanning signals $Y_1$, $Y_7$ and $Y_{15}$ generated in one frame in the driving circuit of the above-mentioned active addressing system. FIGS. 18E, 18F and 18G show the voltage waveforms in one frame at the display dots to which signals $Y_1$ to $X_1$, $Y_7$ to $X_1$ and $Y_{15}$ to $X_1$ are applied, respectively. In these figures, the ordinate indicates a voltage value and the abscissa indicates time. +Vr and −Vr are the output voltage values of the scanning electrode driving circuit 5 and Vc(t) is the output voltage value of the data electrode driving circuit 4. In these figures, all the values are calculated under a condition where all the image data are to be displayed in the on state.

FIGS. 19A through 19G show the voltage waveforms when the data signal $X_1$ has a different voltage waveform from that shown in FIG. 18A.

As is known from FIGS. 18A through 18G, even when all the image data are to be displayed in the same on state, the voltage waveforms at the display dots are significantly different from one another in the driving voltage waveforms and the frequency components depending upon the scanning signals to be applied to the scanning electrodes. Specifically, the waveform shown in FIG. 18E has more low frequency components as compared with the waveform in FIG. 18F, and the waveform in FIG. 18G has further less low frequency components, while the high frequency components increase in this order. This also applies to the waveforms shown in FIGS. 19A through 19G.

Therefore, even when all the image data are to be displayed in the same state, the effective voltage value varies in each display dot due to the difference in the frequency components, resulting in a nonuniform display. The reason is as follows: In an LCD, a low pass filter is formed by resistance components such as an electrode resistance and capacity components in the liquid crystal layer. The frequency components of a voltage applied to each display dot vary due to the low pass filter, resulting in nonuniform effective voltage value. Another possible reason is frequency dependence caused by the characteristics of the liquid crystal material and/or the orientation film in the LCD. Similar problems are caused in the multiple line selection system. Therefore, in either system, display irregularities such as crosstalk are caused, and the display quality is significantly degraded.

The Walsh function will now be described in more detail. When the number L of data is taken as $2^5$, a complete one-dimentional Walsh function system with a cycle of L includes L signals Wal(m,n), wherein m=0, 1, 2, . . . , L−1; and n=0, 1, 2, . . . , L−1. For example, when $L=2^8$, i.e., 256, the Walsh function system includes 256 signals Wal(m,n). Wal(m,n) is defined by the following equations:

$$Wal(0,n) = 1, \text{ wherein } n = 0, 1, 2, \ldots, L-1$$

$$Wal(1,n) = 1, \text{ wherein } n = 0, 1, 2, \ldots,$$

-continued $$(L/2)-1 \text{ or } -1, \text{ wherein } n = (L/2), (L/2)+1, \ldots, L-1$$

$$Wal(m,n) = Wal([m/2,2n]) \cdot Wal(m-2[m/2],n)$$

In the above equations, [] indicates a Gaussian sign, and [a] indicates obtaining a largest integer equal to or smaller than a.

However, since the number N of the scanning electrodes is optionally setted in an LCD, the number N is generally not equal to the number L (i.e., $2^r$). Therefore, in such a case, N signals Wal(m,n) are selected among the $2^5$ signals, and a voltage is applied to them. Since the selected Walsh function system is not complete in this case, problems of contrast degradation and the crosstalk are caused. Therefore, it is impossible to perfectly reproduce a desired display image in the conventional LCD.

In addition, since a fixed voltage signal derived from the Walsh function is applied to the fixed scanning electrodes, the voltage waveforms at respective scanning electrodes are different from one another in frequency components. Such a difference is revealed as a difference in the applied voltage due to the capacity of the liquid crystal display panel and wiring resistance in the LCD, thereby also causing crosstalk.

SUMMARY OF THE INVENTION

The driving device of this invention drives a matrix type display panel having a first substrate, a second substrate opposed to the first substrate, data electrodes disposed on the first substrate substantially in parallel with a first direction, scanning electrodes disposed substantially in parallel with a second direction on a surface of the second substrate facing to the first substrate, and display dots each provided on a crossing of each of the data electrodes and each of the scanning electrodes, the first direction being vertical to the second direction. The driving device comprises an orthogonal function generator for generating a series of orthogonal signals indicating orthogonal function series, an orthogonal transformation arithmetic circuit for receiving display data and the orthogonal signals, and conducting an orthogonal transformation based on the display data and the orthogonal signals to generate data signals, a scanning electrode driving circuit for receiving the orthogonal signals to apply scanning signals corresponding to the orthogonal signals to the scanning electrodes, a data electrode driving circuit for receiving the data signals to apply data voltage signals corresponding to the data signals to the data electrodes synchronously with the scanning signals; and a display inactivity signal (hereinafter DIS) signal generator for generating a DIS signal, the DIS signal being sent to the scanning electrode driving circuit and the data electrode driving circuit for providing a plurality of inactive portions, each having a predetermined potential and a predetermined period, to each of the scanning signals and the data signals.

In one embodiment, the predetermined potential is a ground potential, the scanning electrode driving circuit includes first switching means for receiving the DIS signal to stop output of the scanning signal in accordance with the DIS signal, and the data electrode driving circuit includes second switching means for receiving the DIS signal to stop output of the data signal in accordance with the DIS signal.

In one embodiment, the first and the second switching means provide the inactive portions to the scanning signal and the data signal by grounding the scanning electrode and the data electrode, respectively.

In one embodiment, the predetermined potential is applied to each of the display dots in each of the inactive terms.

Alternatively, the present invention provides a method for driving a display apparatus a matrix type display panel having a first substrate, a second substrate opposed to the first substrate, data electrodes disposed on the first substrate substantially in parallel with a first direction, scanning electrodes disposed substantially in parallel with a second direction on a surface of the second substrate facing the first substrate, and display dots each provided on a crossing of each of the data electrodes and each of the scanning electrodes, the first direction being vertical to the second direction, an orthogonal transformation arithmetic circuit for generating data signals by orthogonally transforming display data by using orthogonal function series, a scanning electrode driving circuit for applying scanning signals corresponding to the orthogonal function series to the scanning electrodes, a data electrode driving circuit for applying data voltage signals corresponding to the data signals to the data electrodes; and a DIS signal generator for generating a DIS signal to provide a plurality of inactive portions, each having a predetermined potential and a predetermined period, to each of the scanning signals and the data signals. The method comprises the steps of applying the DIS signal to the scanning electrode driving circuit and the data electrode driving circuit, providing the inactive portions to the scanning signal in accordance with the DIS signal by the scanning electrode driving circuit, and providing the inactive portions to the data signal in accordance with the DIS signal by the data electrode driving circuit, whereby a plurality of the inactive portions are periodically provided in one frame of voltage signal to be applied to each of the display dots.

In one embodiment, the predetermined potential is a ground potential.

In one embodiment, the scanning electrode driving circuit and the data electrode driving circuit respectively have switching elements for receiving the DIS signal, and the switching elements stop output of the scanning signals and the data signals, respectively, to provide the inactive portions to the voltage signal applied to each of the display dots.

In one embodiment, the scanning electrode driving circuit and the data electrode driving circuit respectively have switching elements for receiving the DIS signal; and the switching elements ground the scanning electrode and the data electrode to provide the inactive portions to the scanning signal and the data signal, respectively.

In one embodiment, the inactive portions of the scanning signal are synchronized with the inactive portions of the data signal.

Alternatively, the driving device of this invention drives a matrix type display panel having a first substrate, a second substrate opposed to the first substrate, data electrodes disposed on the first substrate substantially in parallel with a first direction, scanning electrodes disposed substantially in parallel with a second direction on a surface of the second substrate facing to the first substrate, and display dots each provided on a crossing of each of the data electrodes and each of the scanning electrodes, the first direction being vertical to the second direction, numbers of the data electrodes and the scanning electrodes being M and N, respectively. The driving device comprises an orthogonal function generator for generating a series of orthogonal signals indicating L orthogonal function series, wherein $L=2^r$, r being a natural number, a display data generator for generating N×M display data and N'×M auxiliary data, wherein N'=L−N, an orthogonal transformation arithmetic circuit for receiving the N×M display data, the N'×M auxiliary data and the L orthogonal signals to generate L×M data signals, a scanning electrode driving circuit for receiving the L orthogonal signals to apply scanning signals corresponding to the L orthogonal signals to the scanning electrodes, and a data electrode driving circuit for receiving the data signals to apply data voltage signals corresponding to the N×M data signals to the data electrodes, wherein one frame is divided into L unit terms when $L \geqq N$, and N' auxiliary scanning electrodes are assumed in each unit term.

In one embodiment, the scanning electrode driving circuit divides one frame into [N/L]+1=P+1 block terms when L<N, and divides each of the block terms into L unit terms, and N' auxiliary scanning electrodes are assumed in each term in (P+1)th block term, N' being L(P+1)−N.

In one embodiment, the display panel is a liquid crystal display panel.

Alternatively, the present invention provides a method for driving a display apparatus comprising a matrix type display panel having a first substrate, a second substrate opposed to the first substrate, data electrodes disposed on the first substrate substantially in parallel with a first direction, scanning electrodes disposed substantially in parallel with a second direction on a surface of the second substrate facing to the first substrate, and display dots each provided on a crossing of each of the data electrodes and each of the scanning electrodes, the first direction being vertical to the second direction, numbers of the data electrodes and the scanning electrodes being M and N, respectively, a display data generator for generating display data and auxiliary data, an orthogonal function generator for generating orthogonal signals indicating L orthogonal function series, wherein $L=2^r$, r being a natural number, an orthogonal transformation arithmetic circuit for receiving the display data, the auxiliary data and the L orthogonal signals to generate data signals, a scanning electrode driving circuit for receiving the L orthogonal signals to apply scanning signals corresponding to the L orthogonal signals to the scanning electrodes, and a data electrode driving circuit for receiving the data signals to apply data voltage signals corresponding to the data signals to the data electrodes. The method adopts a first method when $L \geqq N$ and a second method when $L \leqq N$. The first method comprises the steps of dividing one frame into L unit terms, assuming N' auxiliary scanning electrodes in each term, wherein N'=L−N, generating N'×M auxiliary display data corresponding to the N' auxiliary scanning electrodes, conducting an orthogonal transformation based on the display data, the auxiliary display data and the L orthogonal signals to generate L×M data signals, scanning the N scanning electrodes to apply the scanning signals corresponding to the N orthogonal signals to the scanning electrodes and applying the N' orthogonal signals to the auxiliary scanning electrodes, and applying the data voltage signals to the M data electrodes synchronously with the scanning of the scanning electrodes. The second method comprises the steps of dividing one frame into [N/L]+1=P+1 block terms, dividing each of the first to Pth block terms into L unit terms. In each of the L unit terms, it comprises the steps of generating L×M data signals based on the display data corresponding to the L scanning electrodes and the L orthogonal signals, scanning the N scanning electrodes to apply the scanning signals corresponding to the L orthogonal signals to the scanning electrodes, and applying the data voltage signals to the M data electrodes synchronously with the scanning electrodes. In (P+1)th block term, it comprises the steps of dividing the (P+1)th block term into L unit terms. In each of the L unit terms in the (P+1)th block term, it comprises the steps of assuming N' auxiliary scanning electrodes, N' being L(P+1)–N, generating N'×M auxiliary display data corresponding to the N' auxiliary scanning electrodes, generating L×M data signals based on the display data, the auxiliary display data and the L orthogonal signals, and scanning the N scanning electrodes to apply the scanning signals corresponding to the N orthogonal signals to the scanning electrodes and applying the N' orthogonal signals to the auxiliary scanning electrodes.

In one embodiment, the scanning electrode driving circuit makes the scanning signals correspond to a different group of N orthogonal signals selected from the L orthogonal signals in each frame.

In one embodiment, the scanning electrode driving circuit makes a scanning signal correspond to a different orthogonal signal selected from the L orthogonal signals in each frame.

In one embodiment, the scanning electrode driving circuit makes a scanning signal correspond to a different orthogonal signal selected from the L orthogonal signals in each block term.

Thus, the invention described herein makes possible the advantages of (1) providing a driving method for an LCD that can display an image with a high quality without any display irregularities; and (2) providing a driving device for a display panel in which no crosstalk is generated.

These and other advantages of the present invention will become apparent to those skilled in the art upon reading and understanding the following detailed description with reference to the accompanying figures.

BRIEF DESCRIPTION OF THE DRAWINGS

FIG. 9 is an exemplary matrix for explaining a conventional active addressing system.

FIGS. 10A and 10B are diagrams showing signal patterns corresponding to the Walsh function used in the conventional active addressing system.

FIG. 11 is a diagram of image data to be displayed in the conventional active addressing system.

FIGS. 12A and 12B are diagrams for calculating and indicating the added value g used in the conventional active addressing system.

FIGS. 13A through 13C show the states and the waveforms of display dots in the conventional active addressing system.

DESCRIPTION OF THE PREFERRED EMBODIMENTS

The present invention will now be described by way of examples referring to the accompanying drawings.

EXAMPLE 1

In a driving method for a display apparatus according to the present invention, scanning signals and data signals respectively having periodic inactive portions are applied to respective display dots a plurality of times in a frame. In the inactive portion, a voltage applied to the display dot is kept at a fixed level. When the scanning signal and the data signal are arranged to have the inactive portions simultaneously, each of the signals applied to the display dot is divided into short terms by the inactive portions. Thus, voltage signals applied to the display dot attain higher frequencies, and the difference in frequency among the voltage signals becomes smaller. As a result, even if the low frequency components in the signal are removed by a low pass filter formed in the LCD, the frequency component distribution of each voltage signal applied to each display dot approaches an averaged one.

The above-mentioned effect will now be described in more detail.

Figure 1:
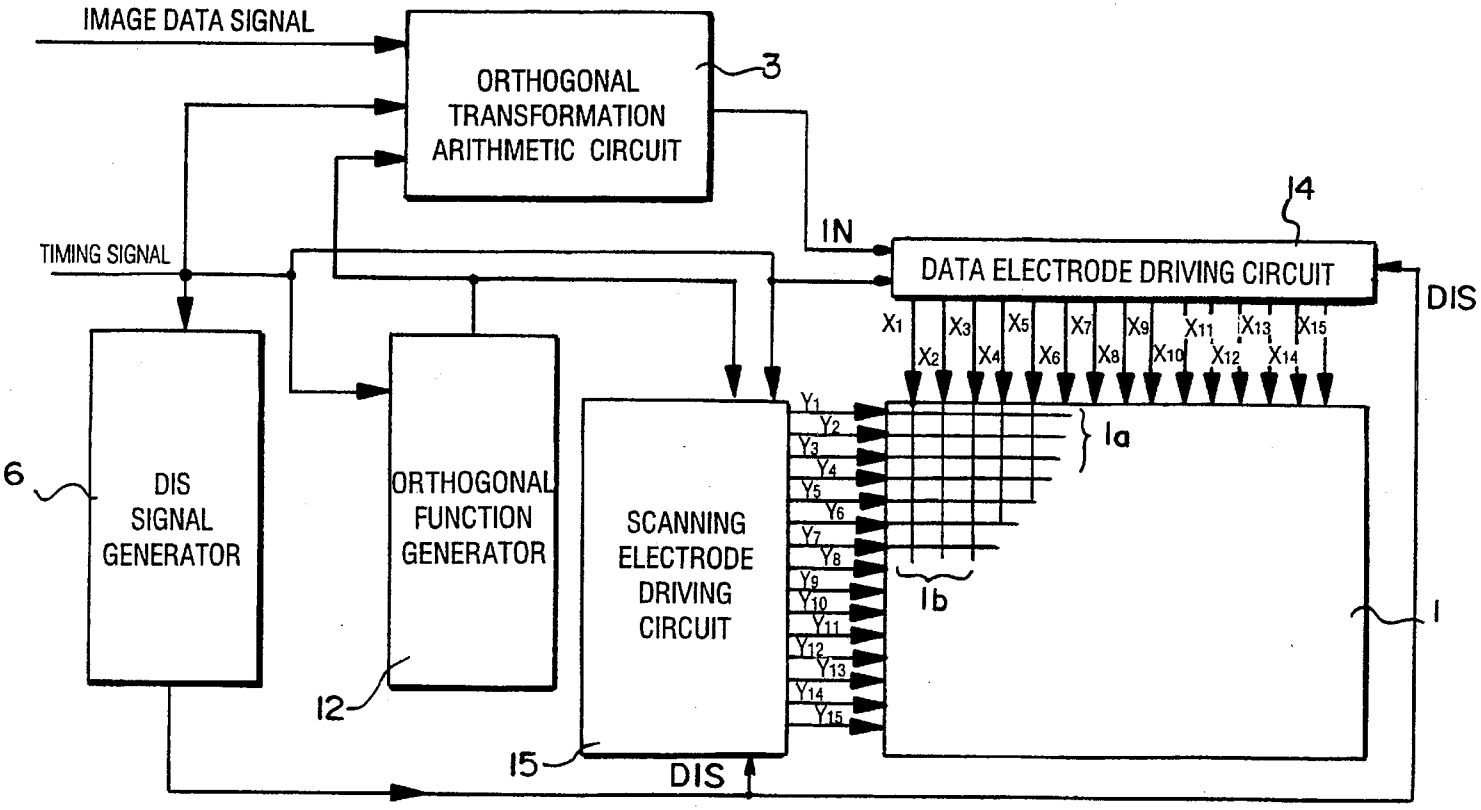
FIG. 1 is a block diagram of an LCD having a driving device according to an example of the present invention.
Figure 15:
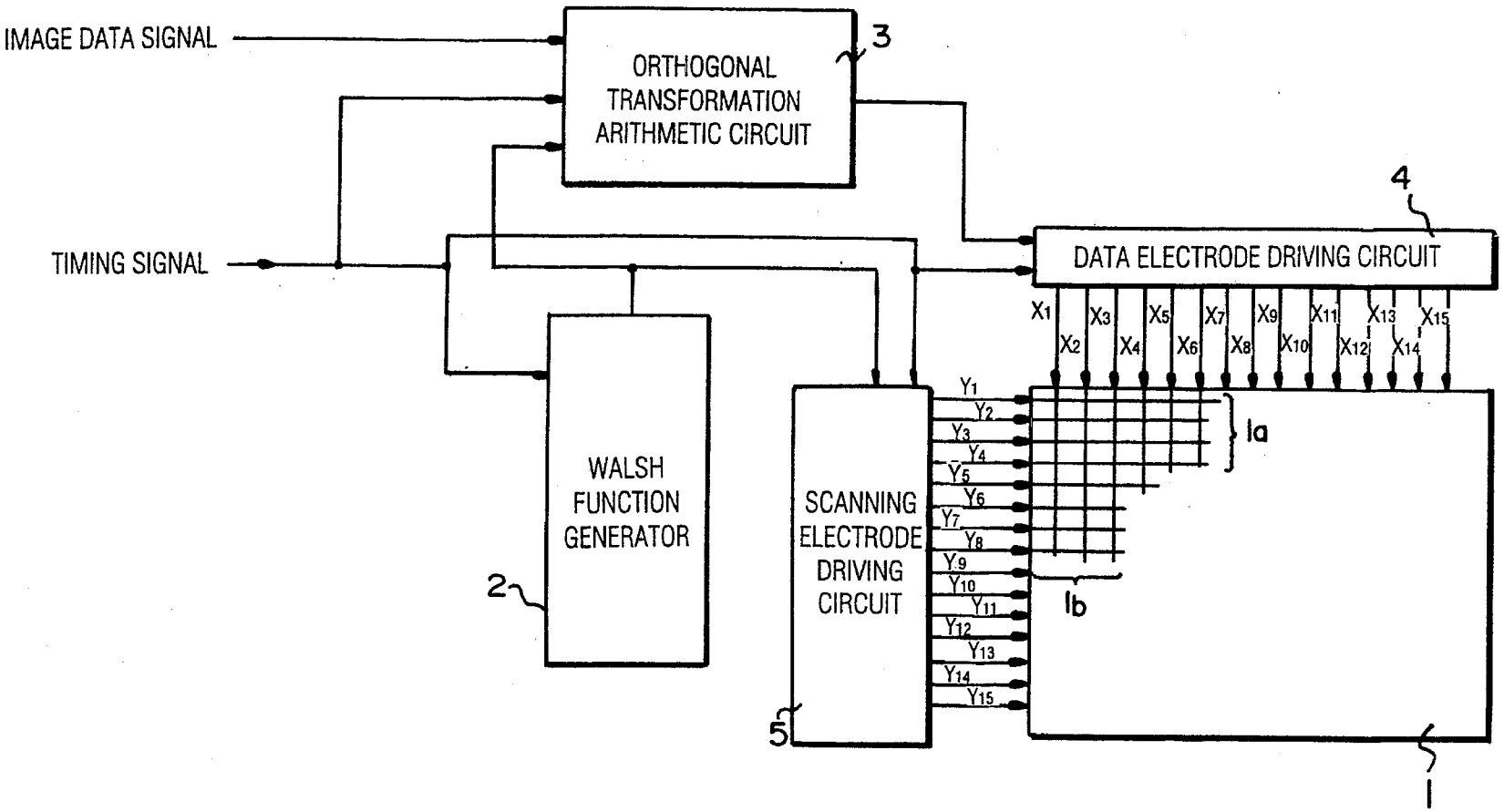
FIG. 15 (PRIOR ART)
FIG. 15 is a block diagram of an LCD of the conventional active addressing system.
Figure 16:
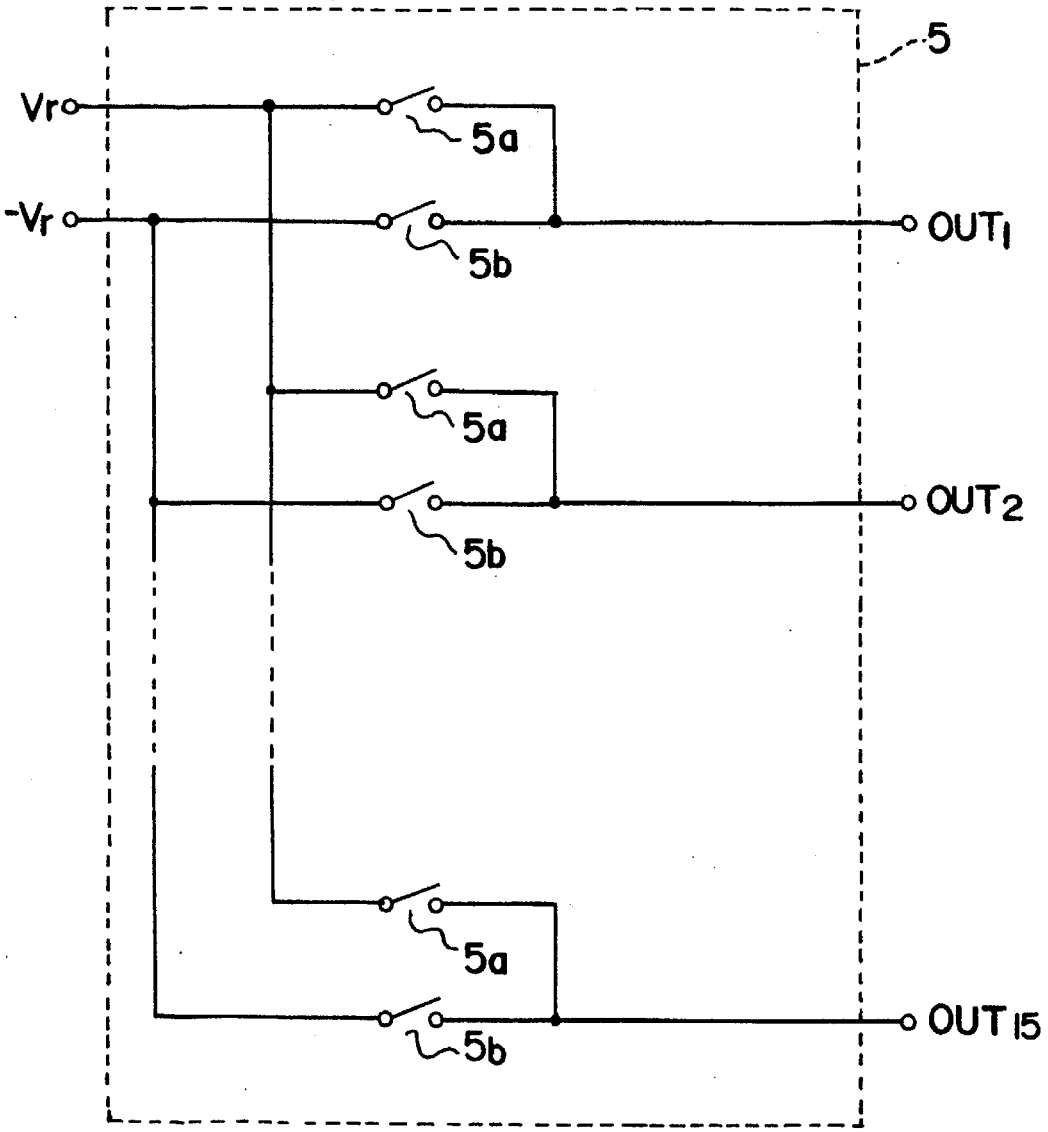
FIG. 16 (PRIOR ART)
FIG. 16 is a block diagram showing a conventional scanning electrode driving circuit in the LCD of FIG. 15.
Figure 17:
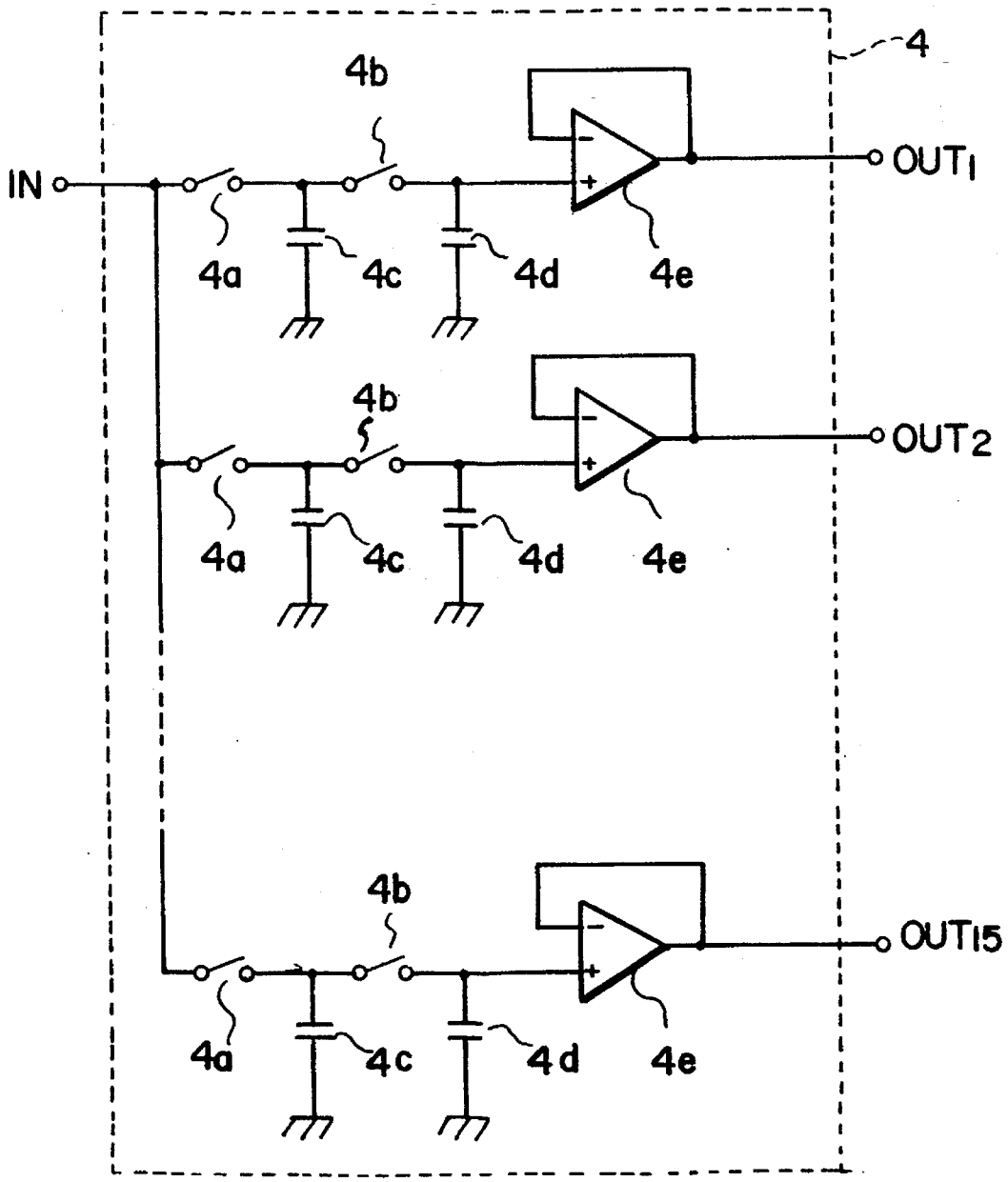
FIG. 17 (PRIOR ART)
FIG. 17 is a block diagram showing a conventional data electrode driving circuit in the LCD of FIG. 15.
Figure 18A:
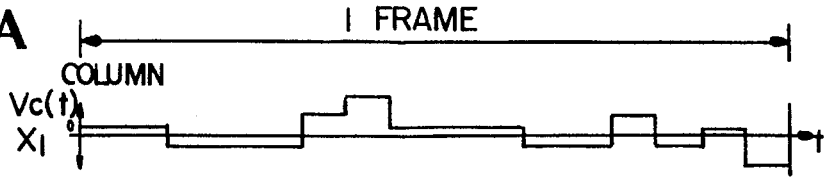
FIG. 18A (PRIOR ART)
FIGS. 18A and 18G are waveforms of signals used in the LCD of FIG. 15.
Figure 18B:
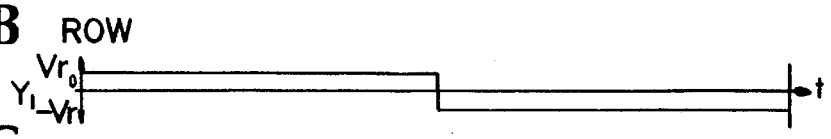
FIG. 18B (PRIOR ART)
Figure 18C:
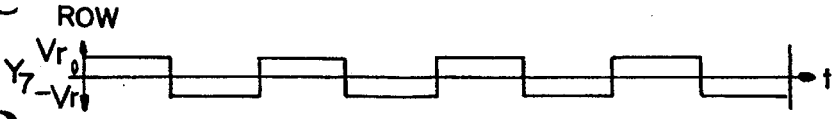
FIG. 18C (PRIOR ART)
Figure 18D:
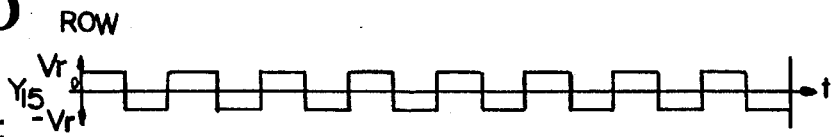
FIG. 18D (PRIOR ART)
Figure 18E:
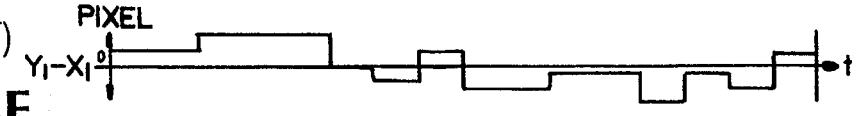
FIG. 18E (PRIOR ART)
Figure 18F:
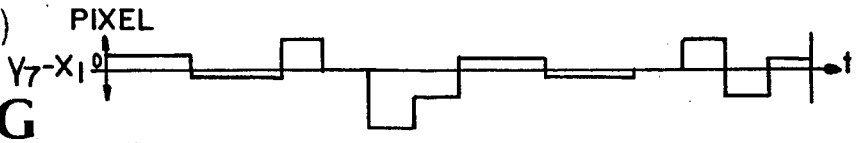
FIG. 18F (PRIOR ART)
Figure 18G:
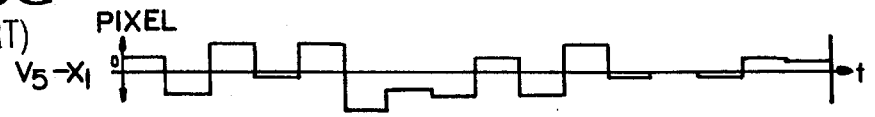
FIG. 18G (PRIOR ART)
Figure 19A:
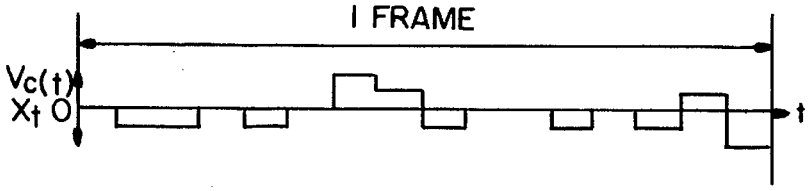
FIG. 19A (PRIOR ART)
FIGS. 19A through 19G are waveforms of signals used in the LCD of FIG. 15.
Figure 19B:
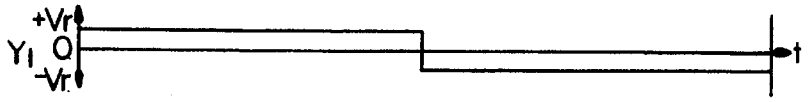
FIG. 19B (PRIOR ART)
Figure 19C:
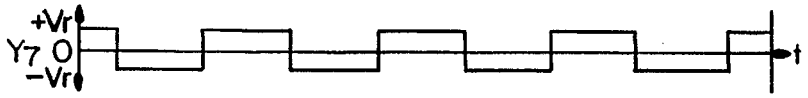
FIG. 19C (PRIOR ART)
Figure 19D:
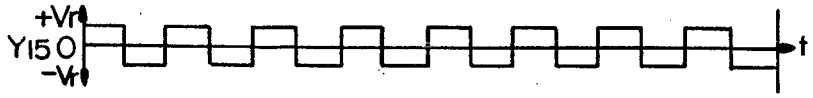
FIG. 19D (PRIOR ART)
Figure 19E:
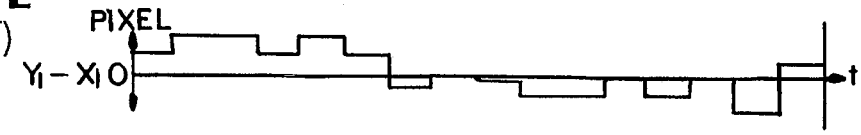
FIG. 19E (PRIOR ART)
Figure 19F:
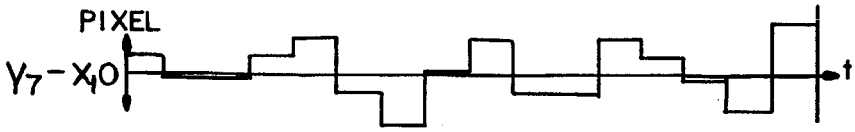
FIG. 19F (PRIOR ART)
Figure 19G:
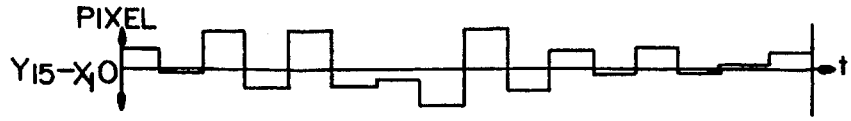
FIG. 19G (PRIOR ART)

FIG. 1 is a block diagram of an LCD system having a driving circuit of this example. Like reference numerals are used to refer to like elements in FIG. 15. The LCD system has an LCD 1 for displaying an image, a data electrode driving circuit 14 and a scanning electrode driving circuit 15 for sending signals to the LCD 1, an orthogonal transformation arithmetic circuit 3 for sending signals to the data electrode driving circuit 14, an orthogonal function generator 12 for sending signals to the orthogonal transformation arithmetic circuit 3 and the scanning electrode driving circuit 15, and a DIS signal generator 6 for providing DIS signals having periodic inactive portions $Z_0$ described below to the data electrode driving circuit 14 and the scanning electrode driving circuit 15. The orthogonal transformation arithmetic circuit 3 receives image data signals. Timing signals are sent to the DIS signal generator 6, the orthogonal function generator 12, the data electrode driving circuit 14 and the scanning electrode driving circuit 15.

The LCD 1 has a liquid crystal layer, and data electrodes 1*b* and scanning electrodes 1*a* opposed each other so as to sandwich the liquid crystal layer therebetween. The data electrodes 1*b* consist of, for example, 15 electrodes to which data signals $X_1$ to $X_{15}$ are applied, and the scanning electrodes 1*a* consist of 15 electrodes to which scanning signals $Y_1$ to $Y_{15}$ are applied. A portion on which each data electrode and each scanning electrode cross each other works as a display dot.

Figure 2:
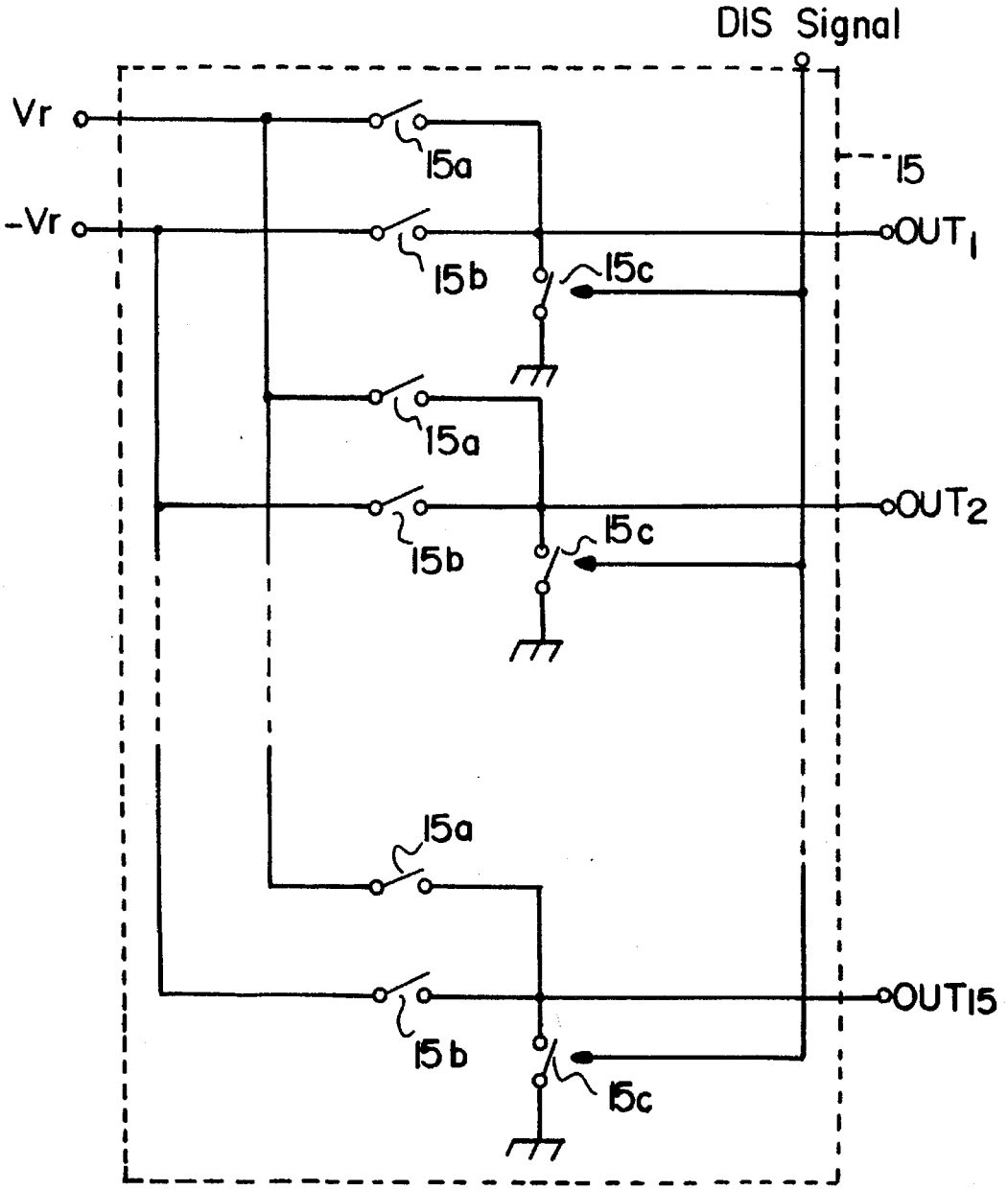
FIG. 2 is a structural view of a scanning electrode driving circuit in the LCD of FIG. 1.

The data electrode driving circuit 14 is connected to the data electrodes 1*b*, and the scanning electrode driving circuit 15 is connected to the scanning electrodes 1*a*. The scanning electrode driving circuit 15 has, in each output system, a transfer gate 15*a* to which a voltage of +Vr is applied, a transfer gate 15*b* to which a voltage of −Vr is applied, and a transfer gate 15*c* to which a DIS signal described below is applied, as shown in FIG. 2. The transfer gates 15*a* and 15*b* select a voltage level between +Vr and −Vr on the basis of a timing signal shown in FIG. 1 to output scanning signals $Y_1$ to $Y_{15}$ to the scanning electrodes 1*a*.

Figure 4A:
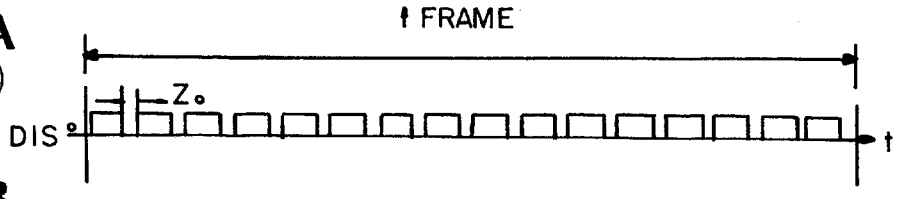
FIG. 4A (PRIOR ART)
FIGS. 4A through 4H are waveforms of signals used in the LCD of FIG. 1.
Figure 4B:
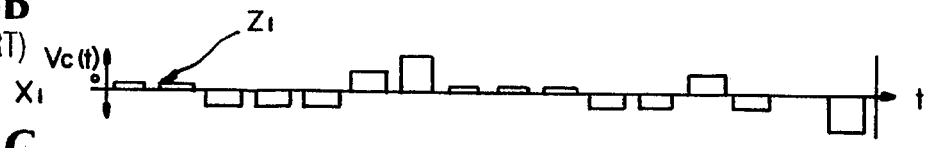
FIG. 4B (PRIOR ART)
Figure 4C:
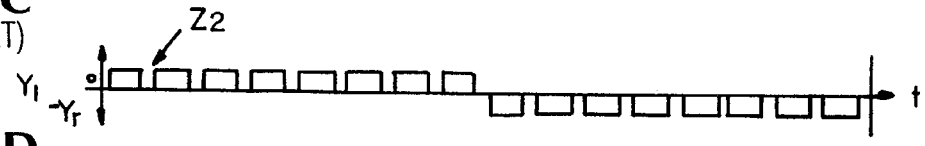
FIG. 4C (PRIOR ART)
Figure 4D:
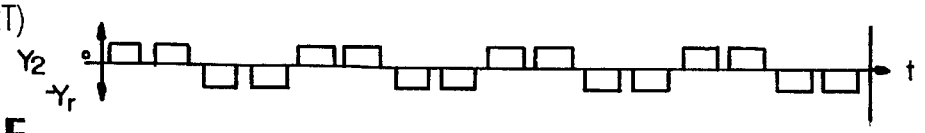
FIG. 4D (PRIOR ART)
Figure 4E:
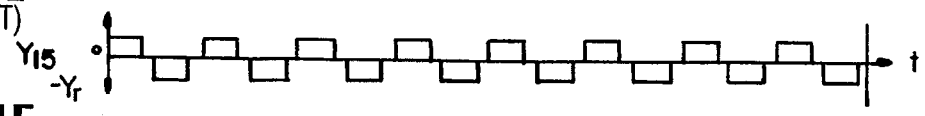
FIG. 4E (PRIOR ART)

The transfer gate 15*c* receives a DIS signal having periodic inactive portions $Z_0$ as shown in FIG. 4A, and is turned off in the inactive portions $Z_0$ and turned on in the other portions. In this manner, the transfer gate 15*c* periodically grounds each output system in accordance with the DIS signal. Therefore, in each output system, when a voltage of +Vr or −Vr is transferred from the transfer gate 15*a* or 15*b*, the resultant signal (i.e., the scanning signal) applied to each scanning electrode 1*a* has inactive portions $Z_2$ in accordance with the times when an applied voltage is grounded to 0. For example, as shown in FIGS. 4C, 4D and 4E, the scanning signals $Y_1$, $Y_7$ and $Y_{15}$ respectively applied to the three scanning electrodes 1*a* have the inactive portions $Z_2$, which correspond to the inactive portions $Z_0$ of the DIS signal.

Figure 3:
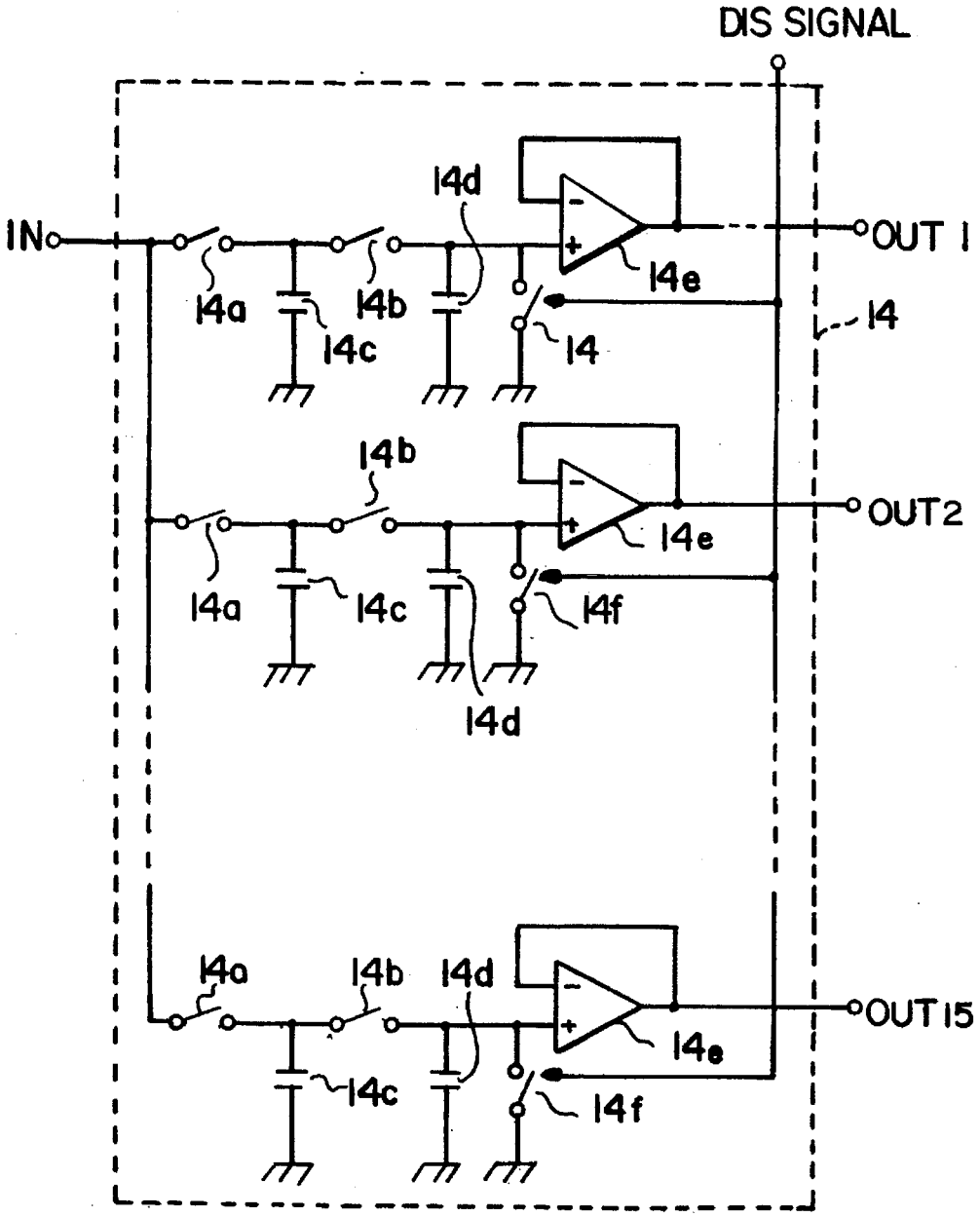
FIG. 3 is a structural view of a data electrode driving circuit in the LCD of FIG. 1.

The data electrode driving circuit 14 has, in each output system, a sampling gate 14*a*, a transfer gate 14*b*, a sampling capacitor 14*c*, a transfer capacitor 14*d*, an output buffer 14*e* and a transfer gate 14*f*, as shown in FIG. 3. The sampling gate 14*a* successively samples arithmetic data Vc(t) in accordance with timing signals. When it finishes sampling all the arithmetic data for one scanning electrode, the transfer gate 14*b* outputs the sampled arithmetic data to the data electrodes 1*b*.

The transfer gate 14*f* receives a DIS signal having periodic inactive portions $Z_0$ as described above, and is turned off in the inactive portions $Z_0$ of the DIS signal and turned on in the other portions. In this manner, the transfer gate 14*f* periodically grounds each output system in accordance with the DIS signal. Therefore, the data signals $X_1$ to $X_{15}$ output from the respective transfer gates 14*b* to the respective data electrodes 1*b* have periodic inactive portions $Z_1$ in accordance with the times when an applied voltage is grounded to 0. For example, the data signal $X_1$ has the inactive portions $Z_1$ corresponding to the inactive portions $Z_0$ of the DIS signal as shown in FIG. 4B.

The data electrode driving circuit 14 receives an output signal from the orthogonal transformation arithmetic circuit 3. The orthogonal transformation arithmetic circuit 3 receives an image data signal, a timing signal, and a function signal output from the orthogonal function generator 12. The orthogonal function generator 12 receives a timing signal. The scanning electrode driving circuit 15 receives a timing signal and an output signal from the orthogonal function generator 12.

In the LCD having the above-mentioned structure, signals are processed as follows: The orthogonal function generator 12 applies fifteen different signal patterns to the respective scanning signals. The orthogonal function generator 12 further divides one frame into fifteen terms. Each voltage signal has voltage levels, each indicating a value of +1 or −1, in the respective terms. The voltage signals are output from the orthogonal function generator 12 to the scanning electrode driving circuit 15.

The scanning electrode driving circuit 15 turns on the transfer gate 15*a* when the voltage signal from the orthogonal function generator 12 indicates +1, and turns on the transfer gate 15*b* when the voltage signal indicates −1, thereby outputting a desired signal. At this point, the transfer gate 15*c* is controlled to be on or off by the DIS signal. Therefore, the signal output from the scanning electrode driving circuit 15 has periodical inactive portions $Z_2$ as described above. The transfer gate 15*c* is preferably turned on/off several times in a frame. In this example, it is turned on/off 16 times in a frame.

In this manner, the scanning signal output from the scanning electrode driving circuit 15 has inactive portions $Z_2$ corresponding to the inactive portions $Z_0$ of the DIS signal. As examples of such scanning signals, FIGS. 4C, 4D and 4E show the voltage waveforms of the scanning signals $Y_1$, $Y_7$ and $Y_{15}$ in one frame. The other scanning signals have similar inactive portions $Z_2$. The scanning signals $Y_1$ to $Y_{15}$ obtained in this manner are applied to the respective scanning electrodes 1*a* by the scanning electrode driving circuit 15.

The orthogonal transformation arithmetic circuit 3 transforms image data signals input from the outside into binary value signals, each having a value of +1 or −1. The value −1 represents the image data being on, and the value +1 represents the image data being off. The orthogonal transformation arithmetic circuit 3 multiplies the value of each binary value signal +1 or −1 by the value +1 or −1 indicated by the voltage signal that is sent from the orthogonal function generator 12 in each term, thereby obtaining the product signal representing the image data and corresponding value of +1 or −1 in each term. The orthogonal transformation arithmetic circuit 3 repeats a similar calculation with regard to the subsequent data signals. When all the product data signals are obtained, the values of the resultant product signals are added up in each term. Then, the obtained sums are multiplied by the constant C to obtain voltage signal values in the respective terms of the data signal, which is sent to the data electrode driving circuit 14.

The transfer gate 14F of the data electrode driving circuit 14 is controlled so as to be turned on/off by the DIS signal. Therefore, the signal output from the data electrode driving circuit 14 has periodical inactive portions $Z_1$ as described above. The transfer gate 14*e* is controlled so as to be turned on/off in the same manner as the transfer gate 15*c* of the scanning electrode driving circuit 15.

In this manner, the data signal output from the data electrode driving circuit 14 has the inactive portions $Z_1$ corresponding to the inactive portions $Z_0$ of the DIS signal. As examples of such data signals, FIG. 4B shows the voltage waveform of the data signal $X_1$ in one frame. The other data signals have similar inactive portions $Z_1$. The data signals $X_1$ to $X_{15}$ obtained in this manner are applied to the respective data electrodes 1*b* by the data electrode driving circuit 14.

An original image is reproduced on the LCD 1 when voltages for one frame are applied to the respective electrodes in the above described manner.

Figure 4F:
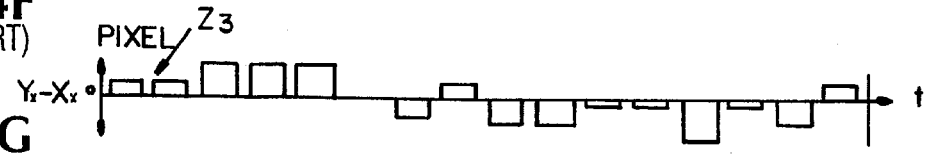
FIG. 4F (PRIOR ART)
Figure 4G:
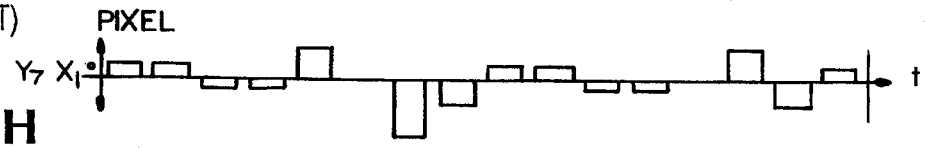
FIG. 4G (PRIOR ART)
Figure 4H:
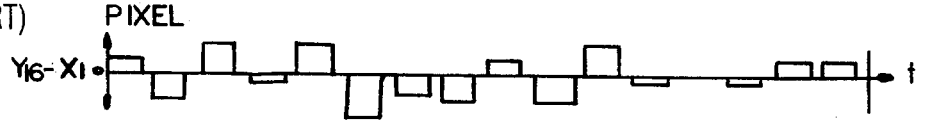
FIG. 4H (PRIOR ART)

According to this example, the scanning signals $Y_1$ to $Y_{15}$ and data signals $X_1$ to $X_{15}$ having periodic inactive portions $Z_2$ and $Z_1$, respectively are applied to the respective display dots several times in one frame. At this point, the timing of applying the scanning signals $Y_1$ to $Y_{15}$ and the data signals $X_1$ to $X_{15}$ to the display dots is adjusted so that the inactive portions $Z_2$ and $Z_1$ are applied to the display dots simultaneously as illustrated at $Z_3$ of FIG. 4F, for example. Therefore, the voltage waveforms at the display dots to which, for example, the signals $X_1$ and $Y_1$, $X_1$ and $Y_7$, and $X_1$ and $Y_{15}$ are applied are indicated as FIGS. 4F, 4G and 4H, respectively. In this manner, the signal applied to each display dot is divided into small terms.

Figure 5A:
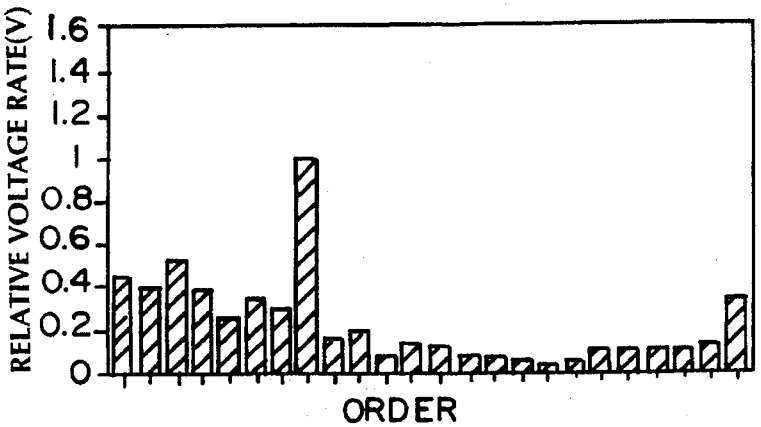
FIGS. 5A through 5D show the relationship between the order of frequency components and the relative voltage ratio of the signal applied to a display dot in the present invention and in the conventional method.
Figure 5B:
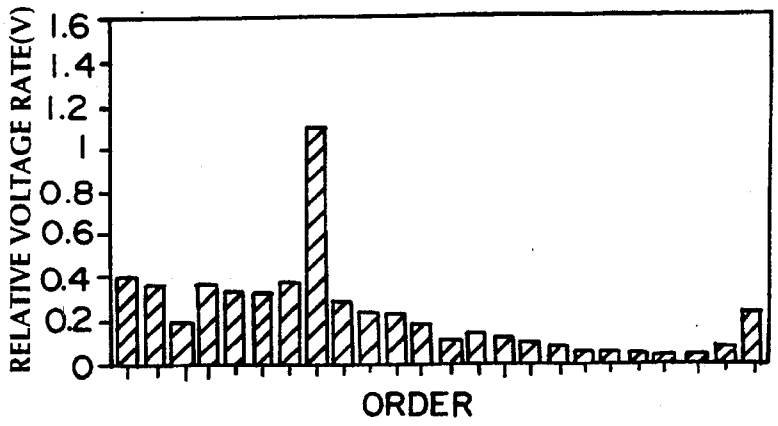
Figure 5C:
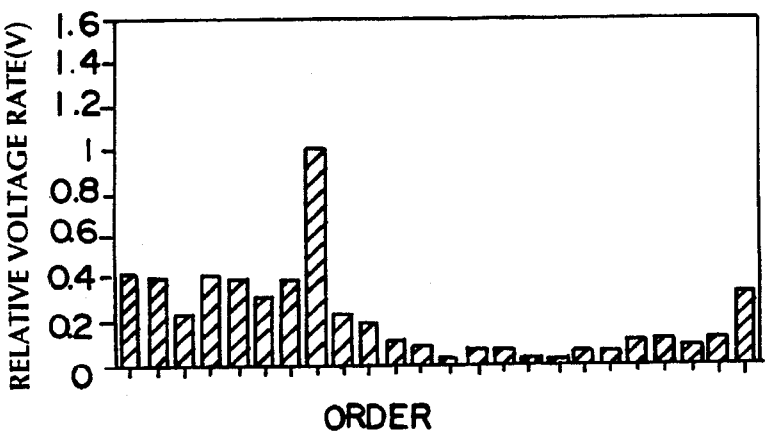
Figure 5D:
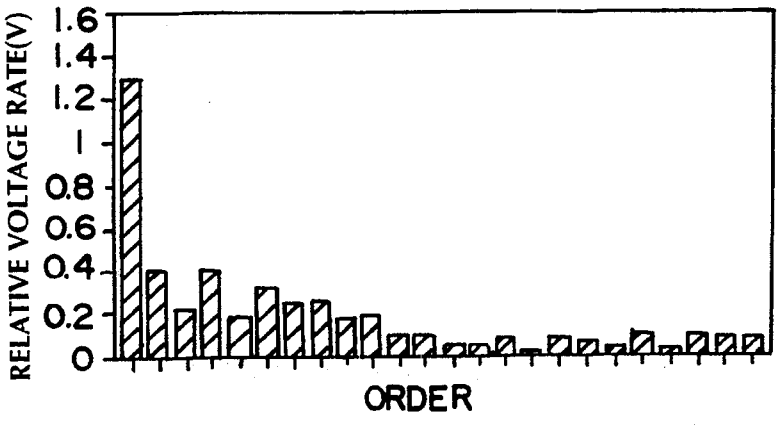

FIGS. 5A and 5B show the relationship between the order of the frequency components of a signal applied to the display dot (the abscissa) and the relative voltage ratio of the frequency components (the ordinate) according to this example. FIG. 5A is obtained by dividing into respective orders of the frequency components of the voltage signal having the waveform shown in FIG. 4H, which is the waveform of the display dot receiving the signals $X_1$ and $Y_{15}$. FIG. 5B is obtained by dividing into the respective orders of the frequency components of the voltage signal having the waveform shown in FIG. 4F, which is the waveform of the display dot receiving the signals $X_1$ and $Y_1$. For comparison, FIGS. 5C and 5D show the similar relationship in the display dots receiving signals $X_1$ and $Y_{15}$, and $X_1$ and $Y_1$, respectively, in a conventional LCD. In the abscissas of these figures, the left end indicates the first order frequency component, and the order of the frequency component increases toward right. The relative voltage ratio herein refers to a ratio of the applied voltage to a predetermined voltage. Each of the signals used in FIGS. 5A to 5D has an inactive portion of 8 μs.

As can be seen from these figures, the signals applied to each display dot in this example have higher frequency components than those used in the conventional method, and the difference in frequency of the applied signal among the respective display dots is smaller due to the inactive portions $Z_3$. More specifically, in FIG. 5D (the conventional method), the relative voltage ratio of the first order frequency component is very high, and the frequency component distribution shown in FIG. 5D is much different from that shown in FIG. 5C. However, in FIG. 5B (this example), the relative voltage ratio of the first order frequency component is lowered and that of the eighth order frequency component is high. There are much smaller differences of the frequency component distribution between the voltage signals applied to the respective display dots shown in FIGS. 5A and 5B as compared with those in FIGS. 5C and 5D.

As a result, even when the low frequency components are removed by a low pass filter formed in the LCD, the frequency component distributions of the voltage signals applied to the respective display dots in one frame are not so much different from each other. Therefore, it is possible to prevent display irregularities such as crosstalk caused by the difference in the frequency component distributions. According to the experiments performed by the present inventors, an excellent image can be displayed in an LCD with a size of approximately 5 inches under conditions of 256×320 dots, a frame frequency of 60 Hz, and a length of the inactive portion of 5 to 8 μs.

In this example, the inactive portions $Z_1$ and $Z_2$ are provided to the data signals and the scanning signals by grounding the lines for transferring the data signals and the scanning signals. The method for providing the inactive portions is not limited to this. It goes without saying that this can also be done by a mechanical method by using an electronic circuit and the like.

The pitch and the length of the inactive portion $Z_0$ can be settled while observing the actual display state in an LCD, or they can be determined by a calculation based on the driving frequency characteristics of the LCD. In addition, the pitch of the inactive portion $Z_0$ is not limited to be constant, and the length of the inactive portion $Z_0$ is not limited to the above-mentioned range.

In the above described example, the inactive portions $Z_1$ and $Z_2$ of the data signal and the scanning signal have the same pitch and the same length. The present invention is not limited to such fixed inactive portions. The inactive portion $Z_1$ of the data signal can have a different cycle from that of the inactive portion $Z_2$ of the scanning signal. In such cases, it is necessary that some of the inactive portions $Z_1$ and $Z_2$ are overlapped on each other. Otherwise, the voltage level of the display dot in the inactive portion varies, and therefore, it is impossible to obtain an inactive portion at which a fixed voltage is applied to each display dot.

The present invention is not limited to an active addressing system using the Walsh function as in the above-mentioned example. The other orthogonal functions such as Rademacher's orthogonal function and Haar's orthogonal function can be used instead.

As described above, according to the present invention, an LCD is driven by using a scanning signal and a data signal, each of which has a plurality of inactive portions in one frame, the frequency component distributions at each display dot can be made similar, thereby preventing display irregularities such as crosstalk. Thus, an LCD with a high quality display can be provided.

EXAMPLE 2

A display apparatus according to the present invention in which no crosstalk is caused will now be described.

First, a method for driving the display apparatus by using an orthogonal function system will be described.

In this example, a matrix display apparatus having a matrix of N×M display dots will be exemplified. In this display apparatus, the number of scanning electrodes N is not equal to the number L ($=2^4$) of bases in the orthogonal function system. From a certain orthogonal function system, $2^r$ complete orthogonal function series are selected. In such cases, there are two possibilities: one is $N<2^5$; and the other is $N>2^r$.

In cases where $N<2^5$

When N is smaller than $2^r$, the display apparatus is driven on the assumption that the number of the scanning electrodes is $2^r$. It is assumed that auxiliary data are displayed on the $(2^r-N)\times M$ display dots corresponding to the extra scanning electrodes that do not really exist (hereinafter referred to as the "auxiliary scanning electrodes"). Signals applied to the data electrodes for the existing display dots are compensated by using the auxiliary data. In this case, one frame is divided into $2^r$ unit terms, and voltages correlated with the bases of the orthogonal function are synchronously applied to the scanning electrodes and the data electrodes in each term.

A maximum ratio for a voltage applied to a selected display dot to a voltage applied to a non-selected display dot is represented by the following:

$$\sqrt{\{(\sqrt{2^r}+1)/(\sqrt{2^r}-1)\}}$$

As $2^r$ (L) becomes large, the maximum voltage ratio decreases. Therefore, it is preferable that $2^r$ approximates the number N of the scanning electrodes.

In cases where $N>2^5$

When N is larger than $2^r$, one frame is divided based on $N/2^r$ as follows:

When $N/2^r=p+a$ (wherein p is an integer; and $0<a<1$), one frame is divided into p+1 block terms. One block term is divided into $2^r$ unit terms, and voltages correlated with the bases of the orthogonal function are synchronously applied to the scanning electrodes and the data electrode in each term.

In this manner, in each block term, the scanning electrodes are successively selected. The scanning electrodes can be successively selected from the top of the display panel to the bottom thereof. The order of the scanning, however, can be optionally determined.

To a non-selected scanning electrode, a half voltage of the voltage applied to a selected scanning electrode is applied. A signal $X_m$ obtained by an arithmetic process based on a desired display data $I_{n,m}$ and the data $Y_n$ of the corresponding scanning electrode is applied to a data electrode.

The (p+1)th block term has $2^r(p+1)-N$ less scanning electrodes than the other block terms. It is assumed that auxiliary data are displayed on the display area corresponding to the missing scanning electrodes ($\{2^r(p+1)-N\}\times M$). Signals from the auxiliary data are arithmetically processed in the above described manner. Based on the results of the arithmetic process, the data signal voltages are compensated to obtain signals to be applied to the data electrodes for displaying the desired image data.

In this method, a desired image can be completely reproduced on the display panel because the entire complete orthogonal function series are used.

The specific procedure will be described referring to FIG. 6.

Figure 6:
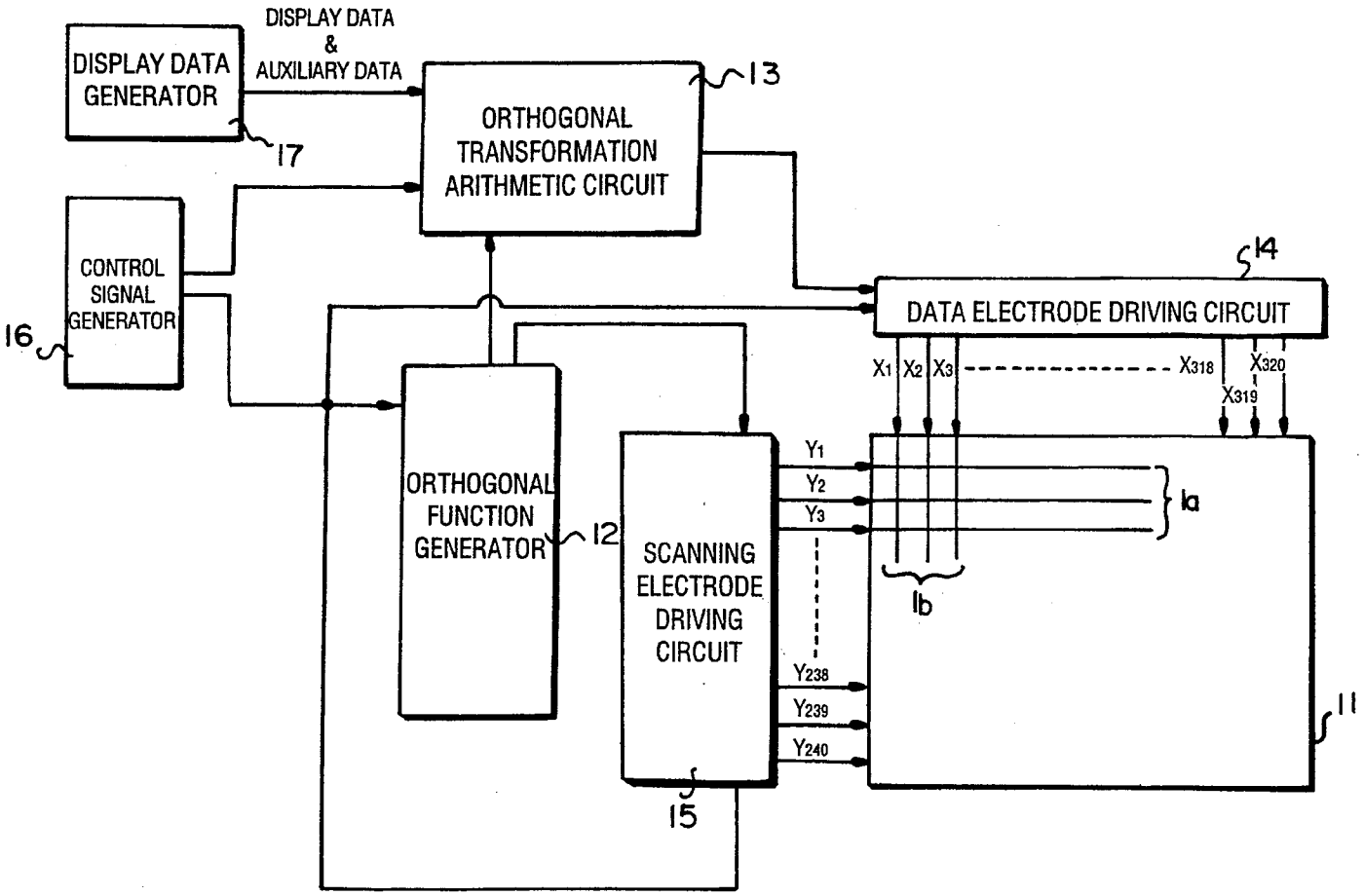
FIG. 6 is a block diagram of a driving device for a display panel according to a second example of the present invention.
Figure 7:
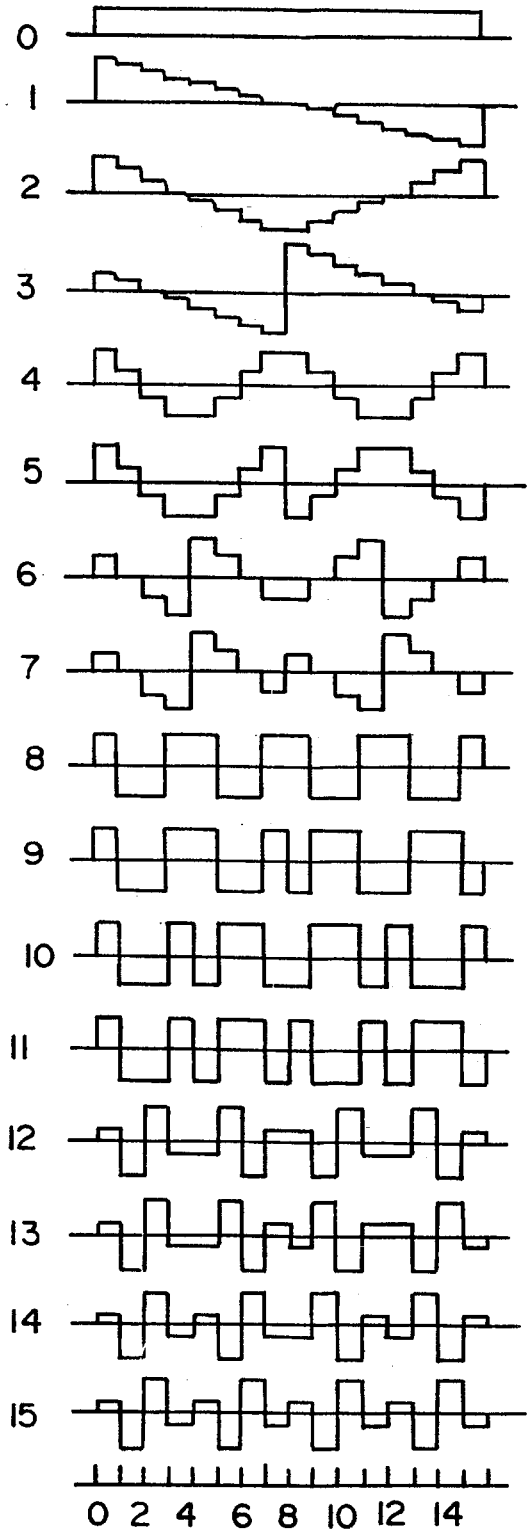
FIG. 7 shows signal patterns of a driving device for the display panel of this invention using a Slant function with function series of $2^4=16$.
Figure 8A:
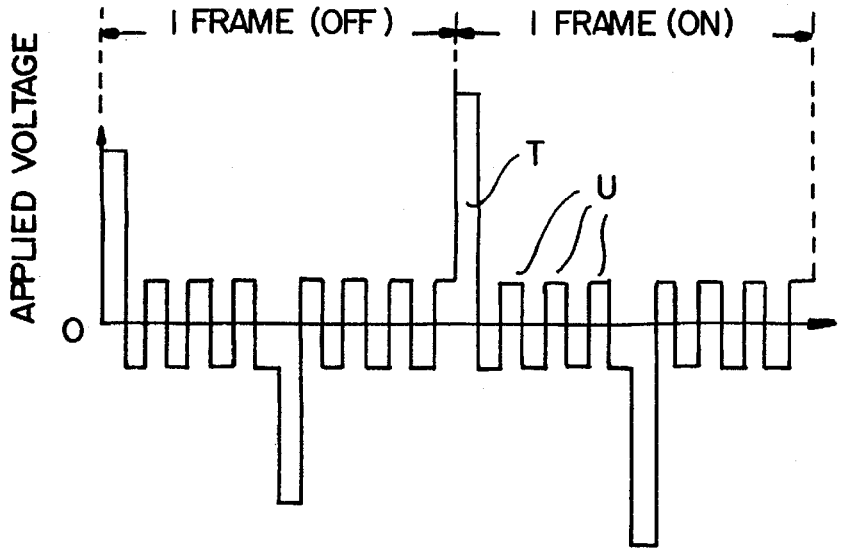
FIG. 8A (PRIOR ART)
FIG. 8A shows a voltage waveform applied to a display dot in each frame in the conventional method.
Figure 8B:
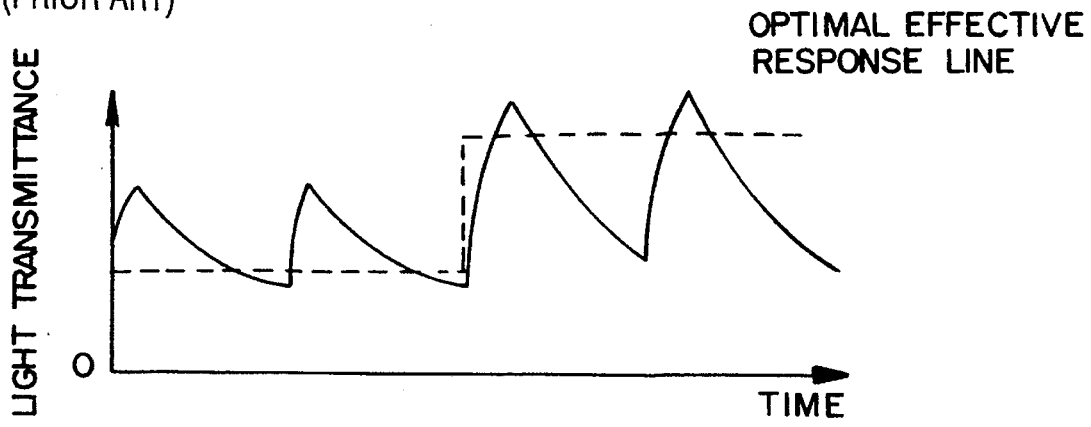
FIG. 8B (PRIOR ART)
FIG. 8B shows the relationship between light transmittance and time corresponding to the waveform shown in FIG. 8A.
Figure 14:
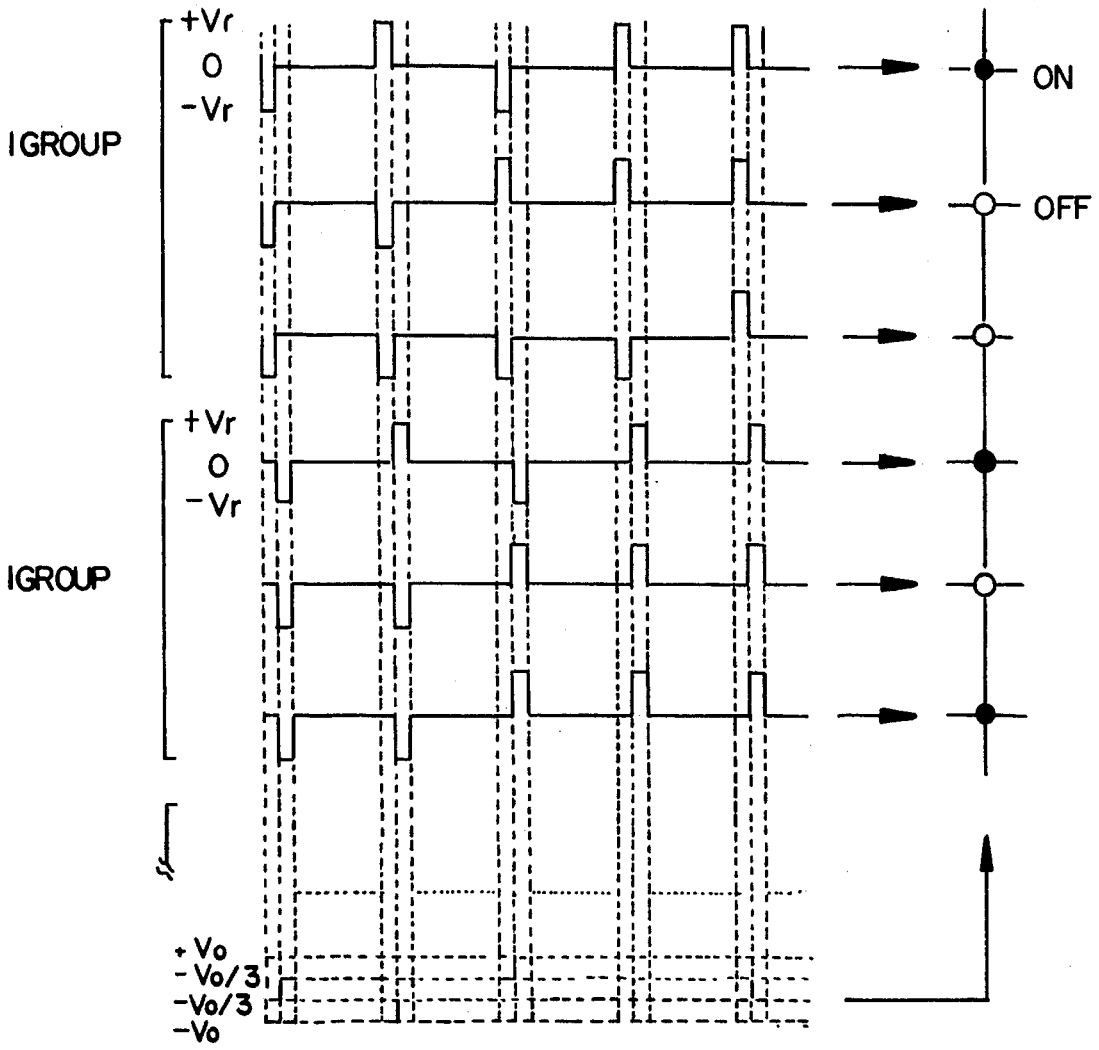
FIG. 14 (PRIOR ART)
FIG. 14 is a diagram for explaining a conventional multiple line selection system.

FIG. 6 is a block diagram for an LCD system having the driving device according to this example. The LCD system has an LCD 11 for displaying an image, the data electrode driving circuit 14 and the scanning electrode driving circuit 15 for applying signals to the LCD 11, the orthogonal transformation arithmetic circuit 13 for applying signals to the data electrode driving circuit 14, the orthogonal function generator 12 for applying signals to the orthogonal transformation arithmetic circuit 13 and the scanning electrode driving circuit 15, a control signal generator 16 for applying control signals to the orthogonal function generator 12, the data electrode driving circuit 14 and the scanning electrode driving circuit 15, and a display data generator 17 for generating display data and auxiliary data. The orthogonal transformation arithmetic circuit 13 receives control signals such as a timing signal, display data and auxiliary data. The orthogonal function generator 12, the data electrode driving circuit 14 and the scanning electrode driving circuit 15 receive control signals such as a timing signal.

The LCD 11 is an STN LCD comprising a liquid crystal layer, and data electrodes **1*b* and scanning electrodes 1*a* opposed each other so as to sandwich the liquid crystal layer. The data electrodes 1*b* are, for example, 320 electrodes to which data signals $X_1$ to $X_{320}$ are respectively applied. The scanning electrodes 1*a* are, for example, 240 electrodes to which scanning signals $Y_1$ to $Y_{240}$ are respectively applied. A portion on which each scanning electrode 1*a* and each data electrode 1*b*** cross each other works as a display dot.

The data electrode driving circuit 14 is connected to the data electrodes **1*b*, and the scanning electrode driving circuit 15 is connected to the scanning electrodes 1*a***.

The data electrode driving circuit 14 receives an output signal from the orthogonal transformation arithmetic circuit 13. The orthogonal transformation arithmetic circuit 13 receives the display data signal and the auxiliary data, a timing signal, and a function signal output from the orthogonal function generator 12. The orthogonal function generator 12 receives a timing signal. The scanning electrode driving circuit 15 receives a timing signal, and a function signal output from the orthogonal function generator 12.

Signals are processed as follows in the driving device having the above-mentioned structure.

The orthogonal function generator 12 generates complete orthogonal function series such as the Walsh function having $2^8=256$ base function series $F_1$ to $F_{256}$. In this example, the orthogonal function generator 12 generates a larger number of base function series than the number of the scanning electrodes **1*a*. One frame is divided into $2^8$ (=256) unit terms. In each unit term, the scanning electrode driving circuit 15**, to which the function series $F_1$ to $F_{256}$ are input, applies signals corresponding to the function series $F_1$ to $F_{240}$ to the scanning electrodes $\mathbf{1}a_1$ to $\mathbf{1}a_{240}$, respectively, under the condition that signals corresponding to the base function series $F_{241}$ to $F_{256}$ are applied to the auxiliary scanning electrodes $\mathbf{1}a_{241}$ to $\mathbf{1}a_{256}$.

The orthogonal transformation arithmetic circuit 13 receives display data corresponding to the display dots of N×M (i.e., 240×320 in this case) and auxiliary data from the display data generator 17. The orthogonal transformation arithmetic circuit 13 stores the data in its memory, and then successively reads the data for each row of the display dots. In this example, the on state is taken as −1, and the off state is taken as 1. A display data $I_{n,m}$ (wherein $1\leqq n\leqq 240$; and $1\leqq m\leqq 320$) is also taken as 1 or −1. The auxiliary data is $I_{n',m}$ (wherein $241\leqq n'\leqq 256$; and $1\leqq m\leqq 320$) is taken as 1. Each of these values is multiplied by the Walsh function series $F_i(t_j)$ having a value of 1 or −1 in each unit term ($t_j$) (wherein $1\leqq i\leqq 256$; and $1\leqq j\leqq 256$). The obtained results are output to the data electrode driving circuit 14.

The data electrode driving circuit 14 multiplies the input values by the constant C. The constant C is 0.065 in this example as calculated by $C=[1/\{2(256-\sqrt{256})\}]^{1/2}$. The data electrode driving circuit 14 applies the calculated product to each of the data electrodes **1*b*** as a data signal $X_m$.

In this example, one frame is divided into 256 unit terms. The voltage calculated by the above-mentioned arithmetic process (arithmetic voltage) in each unit term is synchronously applied to the scanning electrode and the data electrode. Further, all the polarities of the Walsh function series are inverted every frame. As a result, an excellent display with contrast of 20 and a responding rate of 200 ms can be obtained.

In this example, in each unit term, the base function series $F_{241}$ to $F_{256}$ are respectively applied to the auxiliary scanning electrodes $\mathbf{1}a_{241}$ to $\mathbf{1}a_{256}$ and the signals corresponding to the base function series $F_1$ to $F_{240}$ are respectively applied to the actual scanning electrodes $\mathbf{1}a_1$ to $\mathbf{1}a_{240}$. The present invention, however, is not limited to this. It is not necessary to have the fixed base function series $F_1$ to $F_{240}$ correspond to the actual scanning electrodes **1*a*. The function series to be corresponded to the actual scanning electrodes 1*a* can be regularly shifted in each frame, or can be irregularly selected, if similar arithmetic voltages can be synchronously applied to the scanning electrodes and the data electrodes. This can be done by providing appropriate control signals (such as a timing signal) to the orthogonal function generator 12, the orthogonal transformation arithmetic circuit 13, the data electrode driving circuit 14 and the scanning electrode driving circuit 15 from the control signal generator 16**. In such cases, the frequency components of a voltage signal applied to each scanning electrode and each data electrode, which can be varied when the scanning signals are fixed to correspond to the function series $F_1$ to $F_{240}$, can be prevented from deviating, resulting in a decrease in crosstalk in the displayed image.

EXAMPLE 3

In this example, the orthogonal function generator 13 generates the Walsh function having $2^6$ (=64) base function series $F_1$ to $F_{64}$. In this example, namely, the orthogonal function generator 12 generates a smaller number of base function series than the number of the scanning electrodes 1*a*.

One frame is divided into 4 block terms by the scanning electrode driving circuit 15 to which the 64 function series are input. In the first block term, the scanning signals $Y_1$ to $Y_{64}$ corresponding to the base function series $F_1$ to $F_{64}$ are applied to the scanning electrodes $\mathbf{1}a_1$ to $\mathbf{1}a_{64}$, respectively. The rest of the scanning signals $Y_{65}$ to $Y_{240}$ are grounded. The orthogonal transformation arithmetic circuit 13 receives display data corresponding to the display dots of 240×320 from the display data generator 17. The orthogonal transformation arithmetic circuit 13 stores the data in its memory, and then successively reads the data for each row of the display dots. In this example, the on state is taken as −1, and the off state is taken as 1. A display data $I_{n,m}$ (wherein $1 \leqq n \leqq 240$; and $1 \leqq m \leqq 320$) is taken as 1 or −1. In this first block term, $I_{n,m}$ with $1 \leqq n \leqq 64$; and $1 \leqq m \leqq 320$ are used for arithmetic process. Each of these values is multiplied by the Walsh function series $F_i(t_j)$ having a value of 1 or −1 in each term ($t_j$) (wherein $1 \leqq i \leqq 64$; and $1 \leqq j \leqq 64$). The obtained results $$\left( \text{i.e., } g_m(t_j) = \sum_l F_i(t_j) I_{i,m} \right)$$

are output to the data electrode driving circuit 14. The data electrode driving circuit 14 multiplies the input values by the constant C, and applies the obtained product (i.e., $X_m(t_j) = Cg_m(t_j)$) to each of the data electrodes 1*b*.

The term $t_j$ will be omitted in the following description for simplification.

In the second block term, the scanning signals $Y_{65}$ to $Y_{128}$ corresponding to the base function series $F_1$ to $F_{64}$ are applied to the scanning electrodes $\mathbf{1}a_{65}$ to $\mathbf{1}a_{128}$. To the data electrodes 1*b*, the data signals $X_m$ obtained based on the scanning signals $Y_{65}$ to $Y_{128}$ and the display data $I_{n,m}$ (wherein $64 \leqq n \leqq 128$; and $1 \leqq m \leqq 320$) are applied, respectively. The similar procedure is repeated in the third block term.

In the fourth block term, the scanning signals $Y_{193}$ to $Y_{240}$ corresponding to the base function series $F_1$ to $F_{48}$ are applied to the scanning electrodes $\mathbf{1}a_{193}$ to $\mathbf{1}a_{240}$, respectively. To the auxiliary scanning electrodes $\mathbf{1}a_{241}$ to $\mathbf{1}a_{256}$, the scanning signals corresponding to the base function series $F_{49}$ to $F_{64}$ are respectively applied. It is assumed that the auxiliary display dots corresponding to the auxiliary scanning signals $Y_{241}$ to $Y_{256}$ are in the on state. In this manner, the display data $I_{n,m}$ corresponding to the scanning electrodes $\mathbf{1}a_{193}$ to $\mathbf{1}a_{256}$ can be obtained. The data signals $X_m$ (wherein $1 \leqq m \leqq 320$) are calculated based on the scanning signals $Y_{193}$ to $Y_{256}$ and the display data $I_{n,m}$ (wherein $193 \leqq m \leqq 256$; and $1 \leqq m \leqq 320$). The calculated data signals $X_1$ to $X_{320}$ are applied to the respective data electrodes 1*b*.

In the LCD system driven in the above-mentioned manner, an excellent display having contrast of 18 and a responding rate of 180 ms can be obtained.

In this example, a block of scanning electrodes to be selected in each block term is shifted as described above. In the other words, the scanning signals $Y_1$ to $Y_{64}$ are applied in the first term to the scanning electrodes $\mathbf{1}a_1$ to $\mathbf{1}a_{64}$, the scanning signals $Y_{65}$ to $Y_{128}$ are applied in the second term to the scanning electrodes $\mathbf{1}a_{65}$ to $\mathbf{1}a_{128}$, and the like. As a result, the different scanning electrodes are selected in each term in one frame, resulting in a decrease in crosstalk.

The present invention is not limited to the Walsh function, which is used in the above-mentioned examples. Fourier function, Haar function, Karfunen-Loeve function, Slant function and the like can be used as well as the Walsh function. Especially, the Slant function is effective in gradation display. FIGS. 18A to 18G and FIGS. 19A to 19G exemplify the waveforms in selected display dots when the Slant function having $2^4$=16 of base function series is used.

As described above, according to the present invention, even when the number of an orthogonal function series is not equal to the number of scanning electrodes, a desired image can be completely reproduced on the display panel by assuming auxiliary data corresponding to auxiliary scanning electrodes, which do not actually exist. The present invention is useful in preventing crosstalk, which is one of the most serious problems in a conventional LCD. As a result, a display apparatus excellent in contrast, responding rate, and uniformity in the displayed image is provided. The driving device for a display apparatus of this invention can be widely applied in various display apparatuses of the direct view type and the projection type used for OA equipment such as personal computers and word processors, display equipment such as television, a display apparatus for games, and the like.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A driving device for driving a matrix type display panel having a first substrate, a second substrate opposed to the first substrate, data electrodes disposed on the first substrate substantially in parallel with a first direction, scanning electrodes disposed substantially in parallel with a second direction on a surface of the second substrate facing to the first substrate, and display dots each provided on a crossing of each of the data electrodes and each of the scanning electrodes, the first direction being vertical to the second direction, numbers of the data electrodes and the scanning electrodes being M and N, respectively:

the driving device comprising:

an orthogonal function generator for generating a series of orthogonal signals indicating L orthogonal function series, wherein $L=2^r$, r being a natural number;

a display data generator for generating N×M display data and N'×M auxiliary data, wherein N'=L−N;

an orthogonal transformation arithmetic circuit for receiving the N×M display data, the N'×M auxiliary data and the L orthogonal signals to generate L×M data signals;

a scanning electrode driving circuit for receiving the orthogonal signals to apply scanning signals corresponding to the orthogonal signals to the scanning electrodes; and a data electrode driving circuit for receiving the data signals to apply data voltage signals corresponding to the data signals to the data electrodes;

wherein one frame is divided into L unit terms when $L \geqq N$, and N' auxiliary scanning electrodes are assumed in each unit term.

2. A driving device according to claim 1, wherein the scanning electrode driving circuit makes the scanning signals correspond to a different group of N orthogonal signals selected from the L orthogonal signals in each frame.

3. A driving device according to claim 1, wherein the display panel is a liquid crystal display panel.

4. A driving device for driving a matrix type display panel having a first substrate, a second substrate opposed to the first substrate, data electrodes disposed on the first substrate substantially in parallel with a first direction, scanning electrodes disposed substantially in parallel with a second direction on a surface of the second substrate facing the first substrate, and display dots each provided on a crossing of each of the data electrodes and each of the scanning electrodes, the first direction being vertical to the second direction, numbers of the data electrodes and the scanning electrodes being M and N, respectively:

the driving device comprising:

an orthogonal function generator for generating a series of orthogonal signals indicating L orthogonal function series, wherein $L=2^r$, r being a natural number;

a display data generator for generating N×M display data and N'×M auxiliary data, wherein N'=L−N;

an orthogonal transformation arithmetic circuit for receiving the N×M display data, the N'×M auxiliary data and the L orthogonal signals to generate L×M data signals;

a scanning electrode driving circuit for receiving the orthogonal signals to apply scanning signals corresponding to the orthogonal signals to the scanning electrodes; and a data electrode driving circuit for receiving the data signals to apply data voltage signals corresponding to the data signals to the data electrodes;

wherein the scanning electrode driving circuit divides one frame into [N/L]+1=P+1 block terms when L<N, and wherein P is an integer representing the number of blocks, and said scanning electrode driving circuit divides each of the block terms into L unit terms; and N' auxiliary scanning electrodes are assumed in each term in (P+1)th block term, N' being L(P+1)−N.

5. A driving device according to claim 4, wherein the scanning electrode driving circuit makes a scanning signal correspond to a different orthogonal signal selected from the L orthogonal signals in each frame.

6. A driving device according to claim 4, wherein the scanning electrode driving circuit makes a scanning signal correspond to a different orthogonal signal selected from the L orthogonal signals in each block term.

7. A driving device according to claim 4, wherein the display panel is a liquid crystal display panel.

8. A method for driving a display apparatus:

the display apparatus comprising:

a matrix type display panel having a first substrate, a second substrate opposed to the first substrate, data electrodes disposed on the first substrate substantially in parallel with a first direction, scanning electrodes disposed substantially in parallel with a second direction on a surface of the second substrate facing to the first substrate, and display dots each provided on a crossing of each of the data electrodes and each of the scanning electrodes, the first direction being vertical to the second direction, numbers of the data electrodes and the scanning electrodes being M and N, respectively:

a display data generator for generating display data and auxiliary data;

an orthogonal function generator for generating orthogonal signals indicating L orthogonal function series, wherein $L=2^r$, r being a natural number;

an orthogonal transformation arithmetic circuit for receiving the display data, the auxiliary data and the L orthogonal signals to generate data signals;

a scanning electrode driving circuit for receiving the L orthogonal signals to apply scanning signals corresponding to the L orthogonal signals to the scanning electrodes; and a data electrode driving circuit for receiving the data signals to apply data voltage signals corresponding to the data signals to the data electrodes;

a method adopting a first method when L≧N and a second method when L<N;

the first method comprising the method of:

dividing one frame into L unit terms;

assuming N' auxiliary scanning electrodes in each term, wherein N'=L−N;

generating N'×M auxiliary display data corresponding to the N' auxiliary scanning electrodes;

conducing an orthogonal transformation based on the display data, the auxiliary display data and the L orthogonal signals to generate L×M data signals;

scanning the N scanning electrodes to apply the scanning signals corresponding to the N orthogonal signals to the scanning electrodes and applying the N' orthogonal signals to the auxiliary scanning electrodes; and applying the data voltage signals to the M data electrodes synchronously with the scanning of the scanning electrodes;

the second method comprising the steps of:

dividing one frame into [N/L]+1=P+1 block terms, wherein P is an integer representing the number of blocks dividing each of the first to Pth block terms into L unit terms;

in each of the L unit terms, generating L×M data signals based on the display data corresponding to the L scanning electrodes and the L orthogonal signals;

scanning the N scanning electrodes to apply the scanning signals corresponding to the orthogonal signals to the scanning electrodes; and applying the data voltage signals to the M data electrodes synchronously with the scanning electrodes;

in (P+1)th block term, dividing the (P+1)th block term into L unit terms;

in each of the L unit terms in the (P+1)th block term, assuming N' auxiliary scanning electrodes, N' being L(P+1)th−N;

generating N'×M auxiliary display data corresponding to the N' auxiliary scanning electrodes;

generating L×M data signals based on the display data, the auxiliary display data and the L orthogonal signals; and scanning the N scanning electrodes to apply the scanning signals corresponding to the N orthogonal signals to the scanning electrodes and applying the N' orthogonal signals to the auxiliary scanning electrodes.

9. A driving method according to claim 8, wherein the scanning electrode driving circuit makes the scanning signals correspond to a different group of N orthogonal signals selected from the L orthogonal signals in each frame in the first method.

10. A driving method according to claim 8, wherein the scanning electrode driving circuit makes a scanning signal correspond to a different orthogonal signal selected from the L orthogonal signals in each frame in the second method.

11. A driving method according to claim 8, wherein the scanning electrode driving circuit makes a scanning signal correspond to a different orthogonal signal selected from the L orthogonal signals in each block term in the second method.

* * * * *